US007848689B2

(12) United States Patent
Matsuda et al.

(10) Patent No.: US 7,848,689 B2
(45) Date of Patent: Dec. 7, 2010

(54) BELT DRIVE CONTROLLING DEVICE, BELT DEVICE USING THE BELT DRIVE CONTROLLING DEVICE, AND IMAGE FORMING APPARATUS USING THE BELT DEVICE

(75) Inventors: Hiromichi Matsuda, Isehara (JP); Hiroshi Koide, Yamato (JP)

(73) Assignee: Ricoh Company Limited, Tokyo (JP)

( * ) Notice: Subject to any disclaimer, the term of this patent is extended or adjusted under 35 U.S.C. 154(b) by 289 days.

(21) Appl. No.: 12/061,307

(22) Filed: Apr. 2, 2008

(65) Prior Publication Data

US 2008/0247781 A1 Oct. 9, 2008

(30) Foreign Application Priority Data

Apr. 9, 2007 (JP) ..... 2007-102206

(51) Int. Cl.
*G03G 15/01* (2006.01)

(52) U.S. Cl. ..... 399/301

(58) Field of Classification Search ..... 399/162, 399/167, 297, 301–303, 308, 312; 271/69
See application file for complete search history.

(56) References Cited

U.S. PATENT DOCUMENTS

| | | | | |
|---|---|---|---|---|
| 5,995,802 | A | 11/1999 | Mori et al. | |
| 6,324,355 | B1 | 11/2001 | Matsui et al. | |
| 6,941,096 | B2 | 9/2005 | Matsuda et al. | |
| 6,996,357 | B2 | 2/2006 | Matsuda et al. | |
| 7,327,972 | B2 | 2/2008 | Matsuda et al. | |
| 7,343,119 | B2 * | 3/2008 | Matsuda et al. | 399/167 |
| 7,376,375 | B2 * | 5/2008 | Kobayashi et al. | 399/301 |
| 2006/0165442 | A1 | 7/2006 | Kobayashi et al. | |
| 2006/0275056 | A1 | 12/2006 | Matsuda | |
| 2007/0126837 | A1 * | 6/2007 | Takahashi et al. | 347/104 |

FOREIGN PATENT DOCUMENTS

| | | |
|---|---|---|
| JP | 10-78734 | 3/1998 |
| JP | 2000-310897 | 11/2000 |
| JP | 2004-123383 | 4/2004 |
| JP | 2006-235560 | 9/2006 |
| JP | 2006-264976 | 10/2006 |
| JP | 2007-147735 | 6/2007 |
| JP | 2008-257146 | * 10/2008 |

* cited by examiner

*Primary Examiner*—Hoan Tran
(74) *Attorney, Agent, or Firm*—Oblon, Spivak, McClelland, Maier & Neustadt, L.L.P.

(57) ABSTRACT

A belt drive controlling device for controlling drive of an endless belt supported and driven by plural support rollers including a driving roller configured to drive the endless belt to rotate; and a driven roller which is rotated by the endless belt. The device performs arithmetic processing to extract one of two pieces of rotation variation information on two rollers of the support rollers, and perform controlling drive of the belt on the basis of the rotation variation information. A belt device including a belt, plural support rollers, a driving source, the belt drive controlling device, and a detector configured to detect rotation angular displacement or rotation angular velocity of two of the support rollers. An image forming apparatus including an image bearing member, a developing device and a transfer device, wherein the image bearing member and/or the transfer device includes the belt device.

18 Claims, 14 Drawing Sheets

BELT DRIVE CONTROLLING DEVICE, BELT DEVICE USING THE BELT DRIVE CONTROLLING DEVICE, AND IMAGE FORMING APPARATUS USING THE BELT DEVICE

BACKGROUND OF THE INVENTION

1. Field of the Invention

The present invention relates to a belt drive controlling device for controlling drive of a belt which is rotated while supported by plural rollers. In addition, the present invention also relates to a belt device, which transports a material using a belt and the belt drive controlling device, and to an image forming apparatus which produces visual images using a belt and the belt device.

2. Discussion of the Background

Specific examples of apparatuses using a belt device, which transports a material using a belt supported by plural rollers, include image forming apparatuses, which produce visual images using a photoreceptor belt on which a toner image is formed, an intermediate transfer belt to which the toner image is transferred, and/or a feeding belt for feeding a receiving material to transfer the toner image thereon. It is necessary for such image forming apparatuses to precisely control drive of the belt(s) in order to produce high quality images.

Particularly, in direct-transfer type tandem color image forming apparatuses which can produce images at a high speed while having a small size, it is very important to precisely control drive of a feeding belt for feeding a receiving material. In such tandem color image forming apparatuses, a sheet of a receiving material is fed by a feeding belt along plural color image forming units which produce different color toner images so that the different color toner images are transferred onto the receiving material sheet one by one, resulting in formation of a combined multi-color image on the receiving material sheet. The thus formed combined multi-color image is then fixed to the receiving material sheet, resulting in formation of a fixed color image (such as full color images).

FIG. 1 is a schematic view illustrating the image forming section of a direct-transfer type tandem image forming apparatus. The direct-transfer type tandem image forming apparatus will be explained in detail by reference to FIG. 1.

The image forming apparatus includes four image forming units 18K, 18C, 18M and 18Y, which form black, cyan, magenta and yellow toner images, respectively and which are arranged one by one in such a direction that a sheet S of a receiving material is fed. The image forming units 18K, 18C, 18M and 18Y respectively include photoreceptor drums 40K, 40C, 40M and 40Y, on each of which an electrostatic latent image is formed by a charger and a laser light irradiation device. In each of the image forming units, the electrostatic latent image is developed with a developing device, resulting in formation of a toner image on the photoreceptor drum 40.

The thus prepared toner image is transferred by a transfer roller 62 onto the receiving material sheet S, which is fed by a feeding belt 10 while electrostatically adhered to the belt 10. Thus, four color toner images (black, cyan, magenta and yellow toner images) are transferred onto the sheet S while overlaid, resulting in formation of a combined multiple color toner image. The combined color toner image is then heated and pressed by a fixing device 25, and thereby a fixed full color image is formed on the sheet S. In this regard, the feeding belt 10 is rotated by a driving roller 15 while stretched at a proper tension by the driving roller 15 and a driven roller 14.

The driving roller 15 is driven by a driving motor (not shown) so as to rotate at a predetermined revolution, and thereby the feeding belt 10 is allowed to make an endless movement. The receiving material sheet S is timely fed toward the image forming units 18 so that the color toner images are transferred to proper positions of the sheet S. Since the sheet S is fed by the feeding belt 10, the sheet is fed along the image forming units 18 (in order of 18K, 18C, 18M and 18Y) at the same moving speed as that of the feeding belt 10.

In such an image forming apparatus, unless the moving speed of the sheet S (i.e., the moving speed of the feeding belt 10) is even, a misalignment problem in that color toner images are transferred to improper positions of the sheet S, resulting in formation of misaligned color toner images is caused. When such a misalignment problem is caused, for example, a problem in that a combined color line image, which should be formed by precisely superimposing two or more different color line images, looks blurred because the different color line images are formed while separated from each other without superimposed, or a problem, in that a white portion is formed around a black image formed in a background image which consists of overlaid plural color images, occurs.

FIG. 2 is a schematic view illustrating another tandem image forming apparatus, which uses an intermediate transfer belt. In this image forming apparatus, the color toner images, which are formed on the photoreceptors 40 of the image forming units 18, are transferred by the transfer rollers 62 to an intermediate transfer belt 11 one by one so as to be superimposed, resulting in formation of a combined multiple color toner image on the intermediate transfer belt 11. The combined multiple color toner image is then transferred onto the receiving material sheet S. Similarly to the image forming apparatus illustrated in FIG. 1, the misalignment problem is caused unless the moving speed of the sheet S (i.e., the moving speed of the intermediate transfer belt 11) is even.

As illustrated in FIG. 2, the image forming apparatus includes a secondary transfer belt 24, which is rotated while stretched by two rollers, three support rollers 14, and 16, a cleaner 9 configured to clean the intermediate transfer medium 11, a pair of registration rollers 49 configured to stop and timely feed the sheet S, and the fixing device 25 configured to fix the toner images onto the sheet S.

In the above-mentioned tandem image forming apparatuses and other image forming apparatuses which use a feeding belt configured to feed a receiving material sheet, and/or an image bearing belt member (such as photoreceptor belts and intermediate transfer belts) configured to bear a toner image, a banding problem in that an uneven density portion like a band (like stripe images) is periodically formed on a colored background due to uneven feeding of the receiving material sheet and/or the image bearing belt member. Specifically, when a toner image is transferred to a belt or sheet moving at a relatively high moving speed, the transferred toner image is extended in the moving direction of the belt or sheet, resulting in formation of an image having a relatively low image density. In contrast, when a toner image is transferred to a belt or sheet moving at a relatively low moving speed, the transferred toner image is shrunk in the moving direction of the belt or sheet, resulting in formation of an image having a relatively high image density. Thus, a banded (stripe) image is formed, i.e., the banding problem is caused. Particularly, human eyes are very sensitive to banded pale color images.

The moving speed of a belt is varied from various causes. One of the causes is the uneven thickness of the belt in the moving direction thereof. For example, when the belt is prepared by a centrifugal method such that a belt prepared by centrifugal force using a cylindrical die is then baked, a problem in that the thickness of the resultant belt varies in the circumferential direction thereof often occurs. When such a belt as having uneven thickness is used, the moving speed of the belt varies. Specifically, when a relatively thick portion of the belt is contacted with a driving roller, the moving speed of the belt is relatively fast. In contrast, when a relatively thin portion of the belt is contacted with the driving roller, the moving speed of the belt is relatively slow. Thus, the moving speed of the belt varies. The reason therefor is as follows.

FIG. 3 is a graph showing variation of the thickness of a belt in the circumferential direction thereof. Specifically, the belt is used as the intermediate transfer belt 11 of the image forming apparatus illustrated in FIG. 2.

The graph illustrates variation of the thicknesses of the belt in the circumferential direction thereof, i.e., the relationship between the positions of the belt in the circumferential direction (plotted on the X-axis) and the thickness of the positions (plotted on the Y-axis). In this regard, one circuit of the belt is represented as 2π radian. In addition, the deviation from the average thickness (i.e., 100 μm) is plotted on the Y-axis, and the average thickness is represented as the zero point in FIG. 3.

Hereinafter, the variation of thickness of a belt in the circumferential direction per one circuit is referred to as a belt thickness variation.

In this application, the terms of "belt thickness unevenness" and "belt thickness variation" are defined as follows. The term of "belt thickness unevenness" means distribution of the thicknesses of the belt measured with a thickness meter, and such belt thickness unevenness is present in both the circumferential direction (i.e., feeding direction) and the width direction (roller axis direction) of the belt. In contrast, the term of "belt thickness variation" means distribution of the thicknesses of the belt, which influences the belt feeding speed and/or the angular velocity of the driven roller and which causes variation in rotation of the belt and has the same cycle as the rotation cycle of the belt.

FIG. 4 is a schematic view illustrating a portion of a belt looped around a driving roller when the belt and driving roller are observed from the direction of the axis of the roller. The moving speed of a belt 103 changes depending on a pitch line distance (hereinafter referred to as a PLD) between the surface of a driving roller 105 and a belt pitch line indicated by a dotted line in FIG. 4.

When the belt 103 is a uniform single-layered belt and the absolute value of the expansion ratio of the outer surface of the belt is almost the same as that of the contraction ratio of the inner surface of the belt, the PLD is the same as the distance between the center line of the belt in the thickness direction and the inner surface of the belt (i.e., the surface of the driving roller 105). Thus, in the case of a single-layered belt, the PLD is substantially proportional to the thickness of the belt. Therefore, the moving speed of the belt 103 changes depending on the belt thickness variation.

However, when the belt is a multi-layered belt, which is, for example, made of a hard layer and a soft layer, the PLD is a distance between the surface of the driving roller 105 and the belt pitch line, which is different from the centerline of the belt 103. In addition, the PLD changes depending on the belt contact angle, at which the surface of the roller 105 is contacted with the inner surface of the belt 103.

The pitch line distance PLD of a belt is represented by the following equation (1):

$$\mathrm{PLD}=\mathrm{PLD}_{ave}+f(d) \tag{1}$$

wherein $\mathrm{PLD}_{ave}$ represents the average value of the PLD per one circuit of the belt; and $f(d)$ represents a function representing the variation of the PLD, wherein d represents the position of a point of the belt determined on the basis of the reference point of the belt, i.e., the phase of the point determined when the one circuit of the belt is defined as 2π radian.

In the case of a single-layered belt having an average thickness of 100 μm, the $\mathrm{PLD}_{ave}$ is 50 μm as can be understood from FIG. 4.

The function $f(d)$ is highly correlated with the belt thickness variation illustrated in FIG. 3, and is a periodic function having a period corresponding to one circuit of the belt. When the PLD of the belt varies in the circumferential direction thereof, the ratio of the belt moving speed (or belt moving distance) to the angular velocity (or rotation angular displacement) of the driving roller varies, and/or the ratio of the angular velocity (or rotation angular displacement) of the driven roller to the belt moving speed (or belt moving distance) varies.

The relationship between the belt moving speed V and the angular velocity ω of the driving roller 105 is represented by the following equation (2):

$$V=\{r+\mathrm{PLD}_{ave}+kf(d)\}\omega \tag{2}$$

wherein r represents the radius of the driving roller 105, and k represents the PLD variation effective coefficient, which represents the degree of the influence of the PLD variation $f(d)$ on the moving speed (or moving distance) of the belt 103 or the angular velocity (or rotation angular displacement) of the driven roller.

In this regard, the PLD variation effective coefficient k changes depending on the contact state of the belt 103 with the driving roller 105, and the belt contact angle mentioned above.

In equation (2), $\{r+\mathrm{PLD}_{ave}+kf(d)\}$ is hereinafter referred to as the effective roller radius, and the constant portion $(r+\mathrm{PLD}_{ave})$ of the effective roller radius is hereinafter referred to as the constant effective roller radius R. In addition, $f(d)$ is hereinafter referred to as the PLD variation.

It can be understood that since equation (2) includes the PLD variation $f(d)$, the relationship between the belt moving speed V and the angular velocity ω of the driving roller 105 varies. Specifically, even when the driving roller 105 is rotated at a constant angular velocity (i.e., ω is constant), the moving speed of the belt 103 changes depending on the PLD variation $f(d)$.

Specifically, for example, when a relatively thick portion of a single-layered belt is located on the surface of the driving roller 105, the PLD variation takes on a positive value, and thereby the effective roller radius is increased. Therefore, even when the driving roller is rotated at a constant angular velocity, the moving speed of the belt 103 is increased.

In contrast, when a relatively thin portion of a single-layered belt is located on the surface of the driving roller 105, the PLD variation takes on a negative value, and thereby the effective roller radius is decreased. Therefore, even when the driving roller is rotated at a constant angular velocity, the moving speed of the belt 103 is decreased.

Thus, even when the driving roller is rotated at a constant angular velocity, it is impossible to make the belt moving speed constant due to the PLD variation $f(d)$. In other words, it is impossible to control drive of the belt 103 so as to be the target speed only by controlling the angular velocity of the driving roller 105.

In addition, the relationship between the belt moving speed and the angular velocity of a driven roller is similar to the above-mentioned relationship between the belt moving speed V and the angular velocity $\omega$ of the driving roller 105. Specifically, when the angular velocity of a driven roller is measured with a rotary encoder or the like, the belt moving speed V can be determined from the angular velocity of the driven roller using equation (2).

More specifically, for example, when a relatively thick portion of a single-layered belt is located on the surface of the driven roller, the PLD variation takes on a positive value, and thereby the effective roller radius is increased. Therefore, even when the belt is rotated at a constant moving speed (i.e., V is constant), the angular velocity of the driven roller is decreased.

In contrast, when a relatively thin portion of a single-layered belt is located on the surface of the driven roller, the PLD variation takes on a negative value, and thereby the effective roller radius is decreased. Therefore, even when the belt is rotated at a constant moving speed, the angular velocity of the driven roller is increased.

Thus, even when the moving speed of the belt 103 is constant, it is impossible to make the angular velocity of the driven roller constant due to the PLD variation $f(d)$. In other words, it is impossible to control the belt moving speed of the belt 103 at the target speed on the basis of the angular velocity of the driven roller.

In attempting to control drive of a belt while considering the PLD variation $f(d)$, several proposals have been made. For example, published unexamined Japanese patent application No. (hereinafter referred to as JP-A) 2000-310897 (i.e., Japanese patent No. 3,658,262, corresponding to U.S. Pat. No. 6,324,355) discloses a technique in that a belt, which is prepared by a centrifugal molding method and which tends to have a sine-wave form PLD variation in the circumferential direction thereof, is set in an image forming apparatus after measuring the profile (unevenness in thickness) of the belt, and storing the profile data in a flash ROM to control the moving speed of the belt in the apparatus on the basis of the profile data. In this image forming apparatus, a reference mark is formed at a home position on the belt so that the phase of the profile data is matched to that of the unevenness of thickness of the belt. In this technique, a position of the belt is determined on the basis of the reference mark, and then controlling of drive of the belt is performed by canceling the variation of the belt moving speed due to the belt thickness variation.

However, it is necessary for this technique to measure the profile (unevenness in thickness) of the belt with a high precision thickness meter. Therefore, the manufacturing costs of the belt and image forming apparatus seriously increase. In addition, when the belt is replaced with a new belt, it is necessary to input the profile data of the new belt to the image forming apparatus. Further, in the apparatus, the data of the belt thickness unevenness are used instead of the data of the PLD variation $f(d)$, and therefore it is difficult to precisely control drive of a multi-layered belt, although it may be possible to precisely control drive of a single-layered belt.

JP-A 10-78734 (i.e., Japanese patent No. 3,186,610, corresponding to U.S. Pat. No. 5,995,802) discloses a technique in that detection pattern images are formed on a belt, and the pattern is detected with a detection sensor to detect the periodic variation of the belt. In this image forming apparatus, controlling rotation of a driving roller is performed such that the periodic variation of the belt moving speed due to the belt thickness variation is canceled to control driving of the belt.

It is necessary for the image forming apparatus to form detection pattern images in a range corresponding to at least one circuit of the belt. Therefore, a large amount of developer (toner) is used therefor, resulting in increase of the running costs. In addition, in order to precisely detect the variation of the belt moving speed, detection pattern images have to be formed in a range corresponding to plural circuits of the belt to obtain the averaged variation data of the belt moving speed. Therefore, a larger amount of developer (toner) is used therefor, resulting in serious increase of the running costs.

The present inventors and other inventors disclose a belt drive controlling device in JP-A 2004-123383. In the belt drive controlling device, the rotation angular displacement or angular velocity of a driven support roller is detected, and then the alternating component of the of the angular velocity of the driven roller, which has a frequency corresponding to the periodic thickness variation of the belt, is extracted from the detected data. The amplitude and phase of the thus determined alternating component correspond to those of the periodic thickness variation of the belt. In addition, controlling is performed on the basis of the information on the amplitude and phase of the alternating component such that the rotation angular velocity of a driving roller is decreased (or increased) when a relatively thick (or thin) portion is located on the driving roller. By using this technique, the belt can be driven so as to have the predetermined moving speed without being influenced by the variation in thickness of the belt in the circumferential direction thereof. In addition, it is not necessary for this technique to measure the thicknesses of the belt in the manufacturing process thereof to determine the thickness variation, and therefore increase of the manufacturing costs can be avoided. Further, it is not necessary to input such profile data as mentioned above to the image forming apparatus when the belt is replaced with a new belt. Furthermore, it is not necessary to form such detection pattern images as used for the technique disclosed in JP-A 10-78734, resulting in saving of toner.

However, in the belt drive controlling device, the belt thickness variation is considered as a sine (or cosine) periodic function. Therefore, it is necessary to previously determine the belt thickness variation of the entire belt. Specifically, it is necessary to previously determine whether the frequency component included in the belt thickness variation includes only a fundamental frequency component having a period corresponding to one circuit of the belt or a combination of the fundamental frequency component and a high-order frequency component. In addition, when a seam belt having a thick seam is used, abnormal belt thickness variation tends to be caused. In this case, it is difficult to approximate the belt thickness variation at a periodic sine function, and therefore control error may be committed by this method.

Further, in JP-A 2006-264976, the present inventors propose a belt drive controlling device, which improves the belt drive controlling device disclosed in JP-A 2004-123383. The device controls drive of a belt which is rotated while stretched by plural support rollers including a driving roller configured to drive the belt and a driven roller which is rotated by the belt. The device controls drive of the belt by the following method. Specifically, the method includes obtaining information on rotation angular displacement or rotation angular velocity of two support rollers, which have different diameters or which have different properties such that influences of their PLDs on the belt moving speed and their angular velocities are different from each other; and then performing controlling according to the thus obtained information such that the variation of the belt moving speed due to the variation of the PLD in the circumferential direction of the belt is minimized.

In the device mentioned above, the method of calculation of a control parameter to minimize the variation of the belt moving speed (i.e., the PLD variation determining method) is as follows. Specifically, two pieces of rotation variation information, which are included in the rotation information of one or both of the support rollers and which have different phases, are subjected to an addition treatment in which a delay time representing the time needed for the belt to move from one of the rollers to the other roller and a gain of the two rollers are added. In addition, a second addition treatment is performed on the basis of the results of the first addition treatment. Thus, the addition treatment is repeated n times, wherein n is an integer of not less than 1. In the n-time addition treatment, the gain is $G^{2n-1}$, wherein G represents the gain in the first addition treatment, and the delay time is $T^{2n-1}$, wherein T represents the time needed for the belt to move from one of the roller to the other roller.

In the technique, the diameter of the two support rollers has to be different. Namely, there is a limitation on designing the belt feeding device.

Because of these reasons, a need exists for a belt drive controlling device, which can precisely control drive of a belt supported by plural support rollers without any limitation.

SUMMARY OF THE INVENTION

As an aspect of the present invention, a belt drive controlling device is provided, which controls drive of an endless belt supported by plural support rollers including a driving roller configured to drive the endless belt to rotate, and a driven roller rotated by the endless belt and which includes a processor configured to perform an arithmetic processing to extract one of two pieces of information on rotation variation which are included in the information on the rotation angular displacement or rotation angular velocity of two of the support rollers and which have different phases and a period corresponding to the rotation period of the endless belt and to control drive of the belt on the basis of the information obtained from the arithmetic processing.

The arithmetic processing includes the following steps:

1) subjecting information on the difference between the two pieces of information on rotation variation to a delay processing in which a predetermined time determined on the basis of the distance between the two support rollers in the moving direction of the belt is delayed;

2) adding the information on the difference to the information obtained from the delay processing 1);

3) subjecting the information obtained from the addition processing 2) to the delay processing 1);

4) adding the information on the difference to the information obtained from the delay processing 3);

5) repeatedly performing a combination of the delay processing 3) and the addition processing 4) n-times (n is an integer of not less than 1) on the basis of the information obtained from the addition processing 4); and 6) dividing the sum of the information on the difference and the information obtained from the n-th addition processing with n+1.

Alternatively, the steps 3) to 6) can be replaced with the following steps 3') to 6'):

3') subjecting the information obtained from the delay processing 1) to further delay processing 1);

4') adding the information obtained from the addition processing 2) to the information obtained from the delay processing 3');

5') repeatedly performing a combination of the delay processing 3') and the addition processing 4') n-times (n is an integer of not less than 1) on the basis of the information obtained from the addition processing 4'); and 6') dividing the sum of the information on the rotation variation and the information obtained from the n-th addition processing with n+1.

Alternatively, the steps of from 3) to 6) can be replaced with the following steps of from 3") to 6"):

3") subjecting the information obtained from the addition processing 2) to the delay processing 1);

4") adding the information before the delay processing 3") to the information obtained from the delay processing 3");

5") repeatedly performing the addition processing 4") n-times (n is an integer of not less than 1) on the information obtained from the addition processing 4"); and 6") dividing the sum of the information on the rotation variation and the information obtained from the n-th addition processing with n+1.

As another aspect of the present invention, a belt device is provided, which includes:

an endless belt;

plural support rollers which support the endless belt and which include:

at least one driving roller configured to drive the endless belt to rotate; and at least one driven roller which is rotated by the endless belt;

a driving source configured to drive the driving roller;

the belt drive controlling device mentioned above; and a detector configured to detect the rotation angular displacement and/or rotation angular velocity of two of the support rollers.

As yet another aspect of the present invention, an image forming apparatus is provided, which includes:

an image bearing member configured to bear an electrostatic image thereon;

an image forming unit (such as combinations of a charger, a light irradiator and a developing device) configured to form and develop the electrostatic image to form a visual image on the image bearing member; and a transfer device configured to transfer the visual image onto a receiving material optionally via an intermediate transfer medium.

In the image forming apparatus, the image bearing member and/or the transfer device include the belt device mentioned above. For example, the image bearing member includes the belt device as a photoreceptor belt, and the transfer device includes the belt device as a feeding belt device configured to feed the receiving material, the intermediate transfer medium, etc.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the image forming apparatus of the present invention will be explained by reference to drawings.

Figure 5:
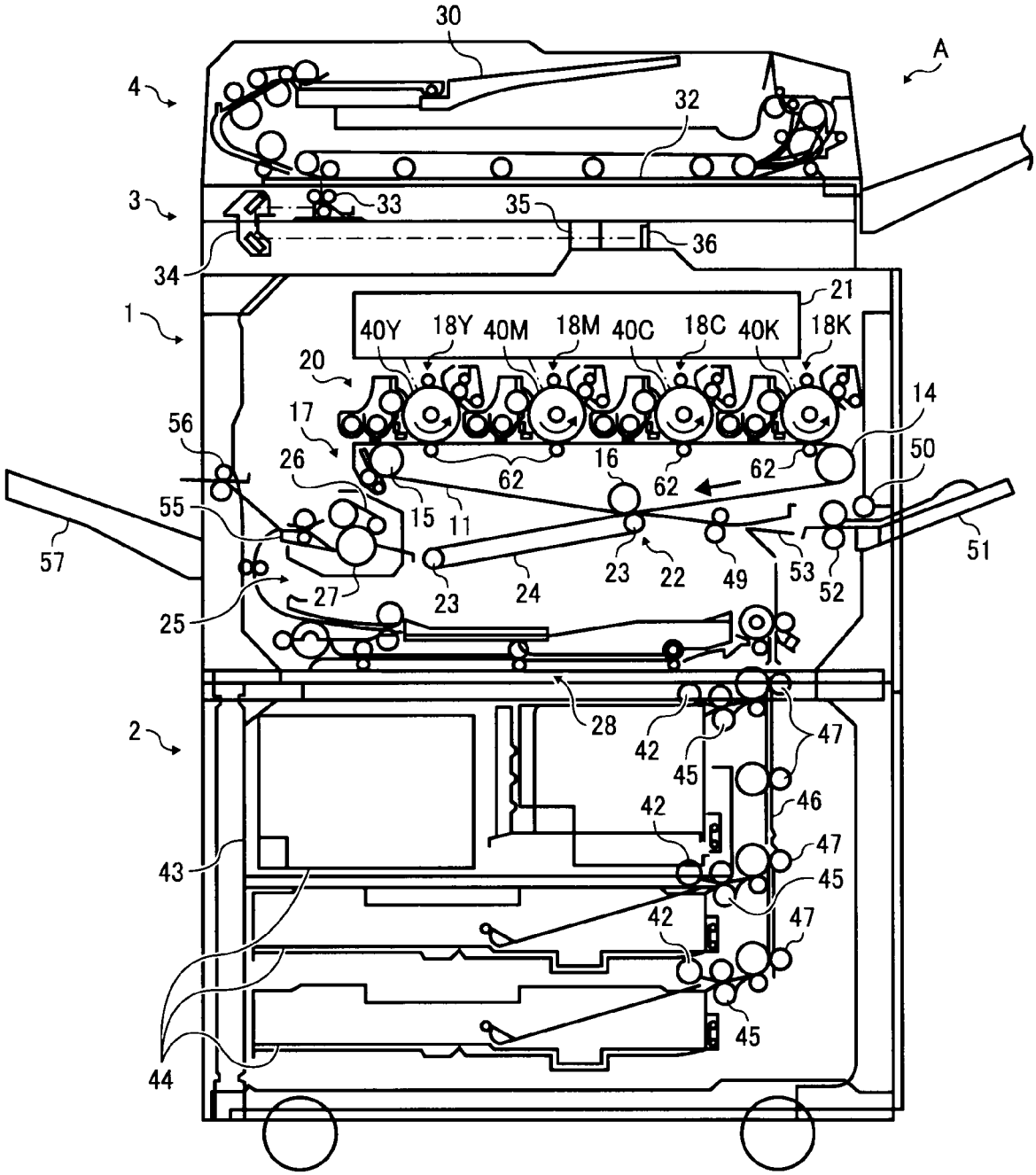
FIG. 5 is a schematic view illustrating an example of the image forming apparatus of the present invention.

FIG. 5 illustrates an example (i.e., a copier) of the image forming apparatus of the present invention.

Referring to FIG. 5, an image forming apparatus A is an electrophotographic copier including a main body 1 of the copier, a receiving material feeding section 2 located below the main body 1 and configured to feed a sheet of a receiving material toward the main body, a scanner 3 located on the main body 1 and configured to scan an original sheet to read the image information of the original sheet, and an automatic document feeder (ADF) 4 located on the scanner and configured to feed an original sheet to the scanner 3.

The main body 1 includes an intermediate transfer belt 11, which is located in the center of the main body and which serves as an intermediate transfer medium configured to bear a visual image (e.g., toner image) thereon. The intermediate transfer belt 11 is supported by three support rollers 14, 15 and 16, and is rotated in a direction indicated by an arrow. In this regard, the roller 16 is a driving roller, and the rollers 14 and 15 are driven rollers.

On the left side of the support roller 15, an intermediate transfer belt cleaner 17 is provided which is configured to remove particles of the developer (such as toner particles) remaining on the surface of the intermediate transfer belt is provided. A tandem image forming section 20 is arranged so as to be opposed to a portion of the intermediate transfer belt 11, which portion is supported while stretched by the rollers 14 and 15.

The tandem image forming section 20 includes four image forming units 18 (i.e., yellow (Y), magenta (M), cyan (C) and black (K) image forming units 18Y, 18M, 18C and 18K), which are serially arranged so as to be opposed to the portion of the intermediate transfer belt 11 and which receive color toner images from the image forming section 20 to form a combined multi-color toner image.

The main body further includes a light irradiating device 21, which is located above the image forming section 20 and which serves as a latent image forming device.

A secondary transfer device 22 is arranged on a location opposite to the tandem image forming section 20 relative to the intermediate transfer belt 11. The secondary transfer device 22 includes a secondary transfer belt 24 supported by two support rollers 23. The secondary transfer belt 24 is pressure-contacted with the support roller 16 with the intermediate transfer belt 11 therebetween.

The combined color toner image formed on the intermediate transfer belt 11 is transferred by the secondary transfer belt 24 to a sheet of a receiving material fed from the receiving material feeding section 2.

On the left side of the secondary transfer device 22, a fixing device 25 configured to fix the color toner image to the receiving material sheet is provided. The fixing device 25 includes a fixing belt 26 and a pressure roller 27 pressed toward the fixing belt 26.

The secondary transfer device 22 also has a function of feeding the receiving material sheet to the fixing device 25. Needless to say, the secondary transfer device 22 may be a transfer roller or a non-contact transfer charger. In these cases, it is difficult for the secondary transfer device 22 to have the feeding function.

The copier A includes a sheet reversing device 28, which is located under the fixing device 25 and which is configured to reverse the receiving material sheet when a double-sided copy is produced.

Then the full color image forming operation of the copier A will be explained.

An original to be copied is set on an original table 30 of the automatic document feeder 4. Alternatively, the original may be directly set on a glass plate 32 of the scanner 3 after the ADF 4 is opened, followed by closing of the ADF 4. When a start button (not shown) is pushed, the color image on the original on the glass plate 32 is scanned with a first traveler 33 and a second traveler 34, which move in the right direction in FIG. 5. In the case where the original is set on the table 30 of the ADF 4, at first the original is fed to the glass plate 32 by the ADF, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) of the original is read.

In parallel with the image reading operation mentioned above, the driving roller 16 is rotated by a motor (not shown) serving as a driving source and thereby the intermediate transfer belt 11 is rotated in the direction indicated by the arrow. In addition, the other two support rollers 14 and 15 (driven rollers) are driven by the intermediate transfer belt 11. At the same time, photoreceptor drums 40 (i.e., 40Y, 40M, 40C and 40K) in the image forming units 18, which serve as latent image bearing members, are also rotated. In this case, electrostatic latent images formed on the photoreceptor drums 40 by the light irradiating device 21 are developed with respective color developers including color toners, resulting in formation of color (Y, M, C and K) toner images on the respective photoreceptor drums 40. The thus prepared color toner images are sequentially transferred onto the intermediate transfer belt 11 by transfer rollers 62 serving as a primary transfer device, resulting in formation of a combined multi-color toner image.

On the other hand, one of paper feeding rollers 42 is selectively rotated to feed the uppermost sheet of paper sheets stacked in one of paper cassettes 44 in a paper bank 43 while the paper sheet is separated one by one by a separation roller 45 when plural paper sheets are continuously fed. The paper sheet is fed to the main body 1 through a passage 46 in the receiving material feeding section 2, and is stopped once by a pair of registration rollers 49. Numeral 47 denotes feed rollers. A receiving material sheet can also be fed from a manual paper tray 51, which is provided on the right side of the main body 1, to a passage 53 by a feed roller 50 and a pair of separation rollers 52. The thus fed receiving material sheet is also stopped once by the registration roller 49, and is then timely fed by the registration rollers 49 to the secondary transfer nip formed by the secondary transfer device 22 and the intermediate transfer belt 11. The registration rollers 49 are generally grounded, but a bias can be applied thereto to remove paper dust therefrom.

The combined multi-color image formed on the intermediate transfer belt 11 is transferred by the secondary transfer device 22 to the receiving material sheet at the secondary transfer nip, and the receiving material sheet is then fed to the fixing device 25 by the secondary transfer device 22. After the color toner image is fixed to the receiving material sheet by the fixing device 25, the receiving material sheet is discharged from the main body 1 by a switchable separating pick 55 and a pair of discharging rollers 56. Thus, a copy is stacked on a tray 57.

Toner particles remaining on the surface of the intermediate transfer medium 11 even after the secondary image transfer operation are removed therefrom by the cleaner 17. Thus, the intermediate transfer belt 11 is ready for the next image forming operation.

The copier can produce not only multi-color images (such as full color images) but also monochrome images (such as black and white images). For example, when black and white images are produced, the intermediate transfer belt 11 is separated from the photoreceptor drums 40Y, 40M and 40C, which are controlled so as not to drive, while contacted with the photoreceptor drum 40K to receive a black image from the photoreceptor drum 40K.

Next, the intermediate transfer belt 11 for use in the belt device and image forming apparatus of the present invention will be explained. However, the belts mentioned below are used not only for the intermediate transfer belt but also for any other belts on which drive controlling is performed.

Single-layered belts made of a resin such as fluorine-containing resins, polycarbonate resins, and polyimide resins, and multi-layered belts in which all or some of the layers are made of one or more elastic materials can be used for the intermediate transfer belt 11. Not only intermediate transfer belts but also other belts used for image forming apparatuses are required to have plural functions. In order to fulfill such requirements, multi-layered belts in which plural layers are overlaid are typically used for intermediate transfer belts. For example, the intermediate transfer belt 11 is required to have functions such as good releasability from toner, good nipping property against photoreceptors, good durability, good stretch resistance, high friction coefficient against driving rollers, and low friction coefficient against photoreceptors.

Regarding the toner releasability, the intermediate transfer belt preferably has a toner releasability such that a toner image thereon can be well transferred onto a receiving material and toner particles remaining on the intermediate transfer belt 11 even after the transfer process can be well removed with a cleaner. Regarding the nipping property, the intermediate transfer belt is preferably well contacted with the photoreceptors 40 so that the toner image on the photoreceptors is transferred thereon at a high transfer ratio.

Regarding the durability, it is preferable for the intermediate transfer belt to be used over a long period of time without causing cracking and abrasion problems, resulting in reduction of the running costs. Regarding the stretch resistance, the intermediate transfer belt preferably has a low expansion and contraction coefficient such that controlling of the moving speed and position of the belt can be precisely performed.

Regarding the friction coefficient, the intermediate transfer belt 11 preferably has a high friction coefficient against the driving roller 16 to prevent slipping of the belt on the driving roller, resulting in stable and precise driving of the belt. In addition, the intermediate transfer belt 11 preferably has a low friction coefficient against the photoreceptors 40 because even when the moving speed of the belt is different from that of the photoreceptors, the stress applied to the belt can be decreased.

Figure 6:
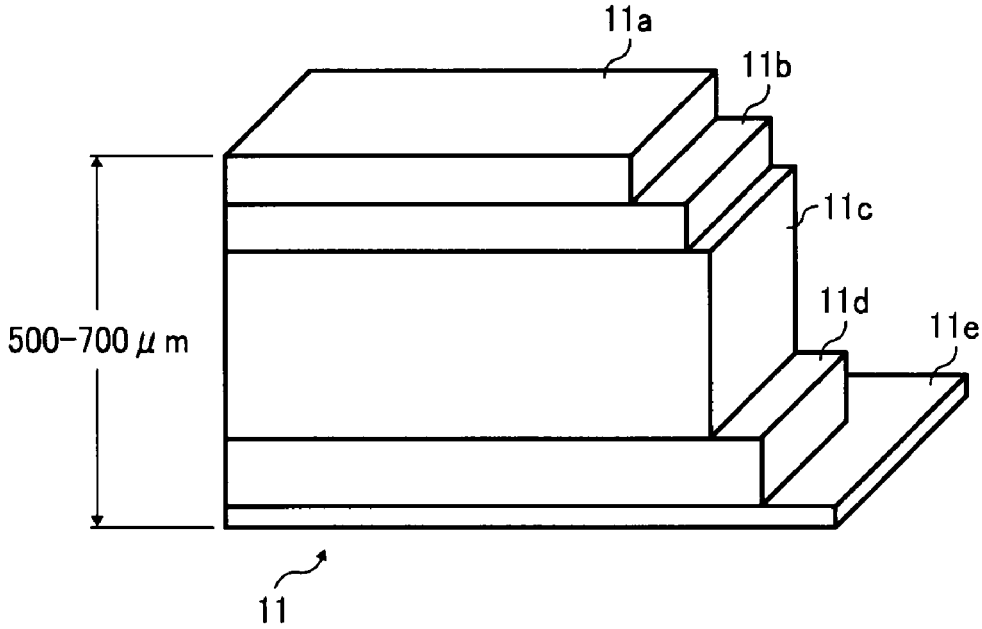
FIG. 6 is a schematic view illustrating a multi-layered intermediate transfer medium.

FIG. 6 is a perspective view illustrating a multi-layered intermediate transfer belt. Such a belt can fulfill the above-mentioned functions at high levels.

Referring to FIG. 6, the intermediate transfer belt 11 is an endless belt having five layers, 11*a*, 11*b*, 11*c*, 11*d* and 11*e*, which are made of different materials. In this regard, the layer 11*a* is contacted with the surface of the photoreceptor 40. The thickness of the belt 11 is from about 500 μm to about 700 μm.

The first layer 11*a* is a coated layer made of a polyurethane resin including a fluorine-containing material. Since the layer includes a fluorine-containing material, the intermediate transfer belt 11 has a relatively low friction coefficient against the photoreceptors 40, and a good toner releasability.

The second layer 11*b* is a coated layer made of a silicone-acrylic copolymer, and has a function of improving the durability of the first layer 11*a* and a function of preventing deterioration of the third layer 11*c* after long repeated use.

The third layer 11*c* is an elastic layer having a thickness of from about 400 μm to about 500 μm and a Young's modulus of from 1 to 20 Mpa, and made of rubber such as chloroprene rubbers. The third layer 11*c* deforms so as to fit to projected portions and recessed portions of a receiving material sheet having a rough surface when the belt 11 is contacted with the receiving material sheet at the secondary transfer nip. Therefore, formation of images having omissions can be prevented even at a relatively low transfer pressure. Namely, images with good evenness can be produced even when a receiving material sheet having a low smoothness is used because the belt can be well contacted with the receiving material sheet.

The fourth layer 11*d* is a layer having a thickness of about 100 μm and made of a resin such as polyvinylidene fluoride. The fourth layer has a function of preventing expansion and contraction of the belt in the circumferential direction thereof. The fourth layer has a Young's modulus of from 500 to 1000 Mpa.

The fifth layer 11*e* is a coated layer made of a polyurethane resin and having a relatively high friction coefficient against the driving roller 16.

Next, each layer will be explained in detail.

In order to prevent contamination of the photoreceptors by the elastic material, to improve the cleanability of the belt by decreasing the friction resistance of the belt (which results in decrease of the adhesiveness of toner to the belt), and to improve the secondary transfer of the toner to the receiving material, one or more of polyurethane resins, polyester resins, and epoxy resins can be used for the first and second layers.

In addition, in order to decrease the surface energy of the belt, resulting in enhancement of the lubricity of the belt, one or more of powders of fluorine-containing resins, fluorine-containing materials, carbon fluoride, titanium dioxide, silicon carbide, etc., can also be added to the first and second layers. Further, two kinds of powders having different particle diameters can be used therefor. Furthermore, the first layer may be a layer which has a low surface energy and which is prepared by forming a fluorine-containing rubber layer, and then subjecting the layer to a heat treatment to prepare a layer in which the surface portion thereof includes fluorine atoms in a relatively large amount.

Specific examples of the rubbers for use in the third layer 11*c* include butyl rubbers, fluorine-containing rubbers, acrylic rubbers, EPDMs, NBRs, acrylonitrile-butadiene-styrene rubbers, natural rubbers, isoprene rubbers, styrene-butadiene rubbers, butadiene rubbers, ethylene-propylene rubbers, ethylene-propylene terpolymers, chloroprene rubbers, chlorosulfonated polyethylene, chlorinated polyethylene, urethane rubbers, syndiotactic 1,2-polybutadiene, epichlorohydrin rubbers, silicone rubbers, fluorine-containing rubbers, polysulfide rubbers, polynorbornene rubbers, hydrogenated nitrile rubbers, elastomers (e.g., polyethylene elastomers, polyolefin elastomers, polyvinyl chloride elastomers, polyurethane elastomers, polyamide elastomers, polyurea elastomers, polyester elastomers, and fluorine-containing elastomers), etc. These materials can be use alone or in combination.

Specific examples of the materials for use in the fourth layer 11*d* include polycarbonate resins, fluorine-containing resins (such as ETFEs and PVDFs), homopolymers or copolymers of styrene or styrene derivatives such as polystyrene resins, chloropolystyrene resins, poly-α-methylstyrene resins, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, and styrene-phenyl methacrylate copolymers), styrene-methyl α-chloroacrylate copolymers, and styrene-acrylonitrile-acrylate copolymers; methyl methacrylate resins, butyl methacrylate resins, ethyl acrylate resins, butyl acrylate resins, modified acrylic resins (e.g., silicone-modified acrylic resins, vinyl chloride resin-modified acrylic resins, and acrylic urethane resins), vinyl chloride resins, vinyl chloride-vinyl acetate resins, rosin-modified maleic acid resins, phenolic resins, epoxy resins, polyester resins, polyester polyurethane resins, polyethylene, polypropylene, polybutadiene, polyvinylidene chloride, ionomer resins, polyurethane, silicone resins, ketone resins, ethylene-ethyl acrylate copolymers, xylene resins, polyvinyl butyral, polyamide modified phenylene oxide resins, etc. These resins are used alone or in combination.

This intermediate transfer belt has a structure such that a rubber layer (such as the third layer) is formed on a resinous core layer (such as the fourth layer) to prevent stretching of the elastic belt. One or more materials which can prevent stretching of the belt can be included in the core layer (such as fourth layer). Specific examples of the stretch preventing materials include natural fibers such as cotton fibers and silk fibers; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers and phenolic fibers; inorganic material fibers such as carbon fibers, glass fibers and boron fibers; metal fibers such as iron fibers and copper fibers; etc. These materials are used alone or in combination. In addition, the fibers can have a form of woven cloth or yarn.

The material is not limited thereto. For example, the fiber may be constituted of single filament or plural filaments, which are twisted. Specific examples of the twisted yarns include single-twisted yarn, double-twisted yarn, two-folded yarn, etc. In addition, blended fabrics constituted of two or more of the above-mentioned fibers. In addition, the fiber can be subjected to an electroconductive treatment. The weaving method is not particularly limited, and any known weaving methods such as stockinet can be used. In addition, clothes made by weaving two or more of the above-mentioned fibers can also be used. The clothes can be subjected to an electroconductive treatment.

However, the method for forming the core layer is not limited thereto. For example, the following methods can also be used.

(1) A method in which a cloth having a cylindrical form is set on a die, and a cover layer is formed thereon.

(2) A method in which a cloth having a cylindrical form is dipped in a liquid rubber to prepare a rubber layer on one side or both sides of the cloth.

(3) A method in which yarns are spirally wound around a die at proper pitches, and a cover layer is formed thereon One or more of the layers can include an electroconductive material for controlling the resistance of the layers. Specific examples thereof include carbon black, graphite, powders of metals such as aluminum and nickels, metal oxides such as tin oxide, titanium oxide, antimony oxide, indium oxide, potassium titanate, antimony oxide-tin oxide complex oxides (ATO), and indium oxide-tin oxide complex oxides (ITO), but are not limited thereto. The electroconductive metal oxides may be coated with a particulate insulating material such as barium sulfate, magnesium silicate and calcium carbonate.

Figure 1:
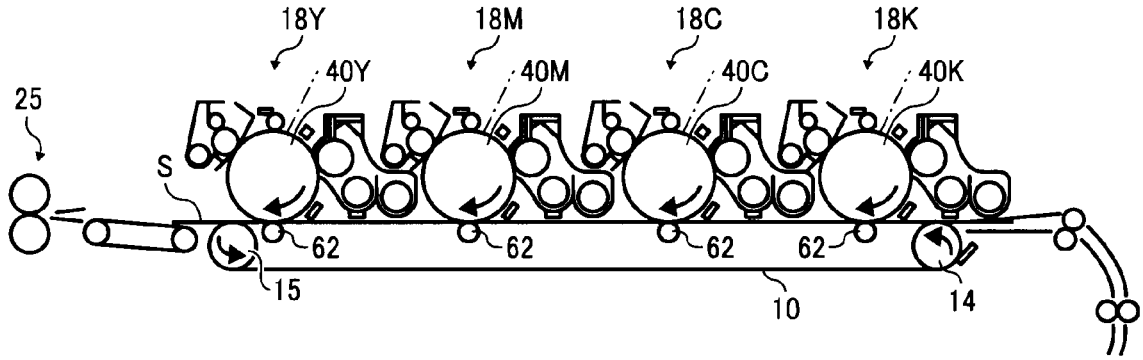
FIG. 1 is a schematic view illustrating the main portion of a direct transfer type tandem image forming apparatus.
Figure 2:
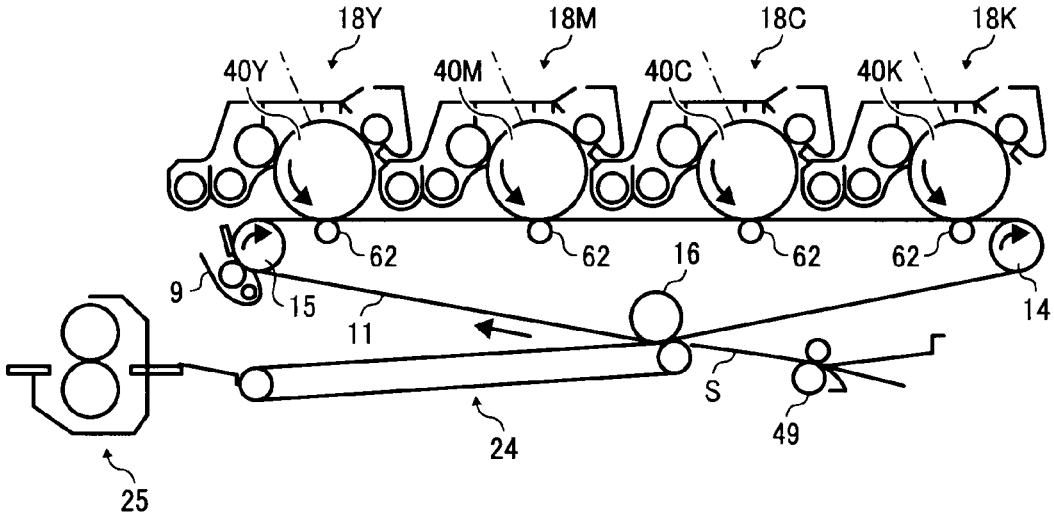
FIG. 2 is a schematic view illustrating the main portion of a tandem image forming apparatus using an intermediate transfer medium.
Figure 3:
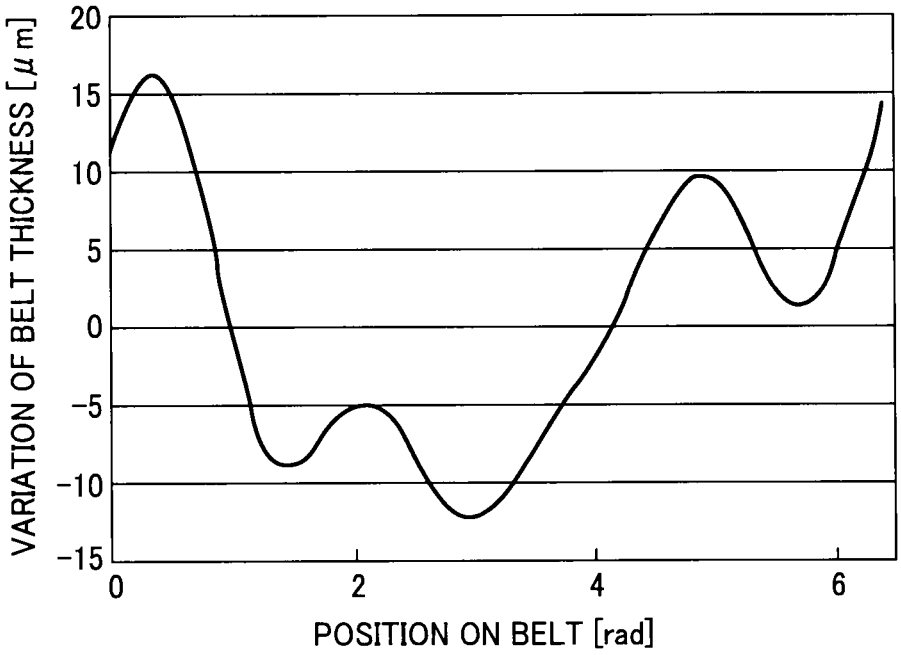
FIG. 3 is a graph showing variation of the thickness of a belt in the circumferential direction thereof.
Figure 4:
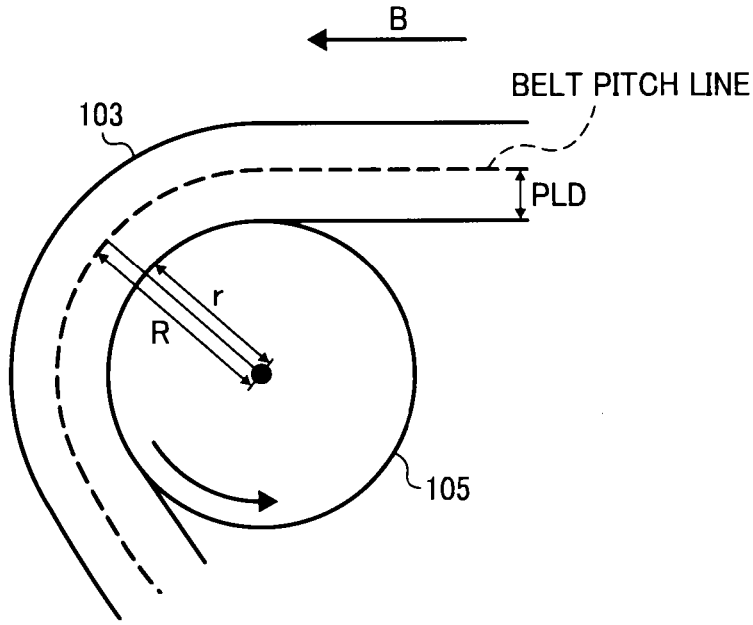
FIG. 4 is a schematic view illustrating a portion of a belt looped around a driving roller when the belt and driving roller are observed from the direction of the axis of the roller.

When the intermediate transfer belt is a single-layered belt, the expansion/contraction ratio of the inner surface of the belt is the same as that of the outer surface thereof. Therefore, the belt pitch line illustrated in FIG. 4 is identical to the center line of the belt in the thickness direction. However, in the case of the multi-layered belt illustrated in FIG. 6, the belt pitch line is not identical to the center line. When a layer (i.e., stretch resistant layer) having a Young's modulus much greater than the other layers is present in such a multi-layered belt, the belt pitch line is present near the center line of the layer. This is because such a layer serves as a core layer and the other layers are expanded or contracted when the belt is stretched by plural rollers.

In the intermediate transfer belt 11 illustrated in FIG. 6, the fourth layer 11*d* has a much higher Young's modulus than the other layers. Therefore, the belt pitch line is present inside the fourth layer 11*d*. In addition, the PLD varies depending on the variation in thickness of the fourth layer. Namely, in a multi-layered belt, the PLD thereof varies depending on the variation in thickness of the layer having the highest Young's modulus.

Further, the PLD of the belt 11 also varies if the position of the fourth layer 11*d* changes (i.e., the fourth layer causes displacement) in the thickness direction of the belt along the circumferential direction of the belt. For example, when the fifth layer 11*e* located between the fourth layer 11*d* and the support roller 105 (illustrated in FIG. 4) has large thickness variation, the position of the fourth layer 11*d* relative to the surface of the support roller 105 is changed, and thereby the PLD of the belt is changed.

In addition, there is a case where a belt having a seam is used for the belt. Such a seam belt is typically prepared by melt-adhering both end portions (about 2 mm in length) of a polyvinylidene fluoride sheet serving as the fourth layer, and then sequentially forming the other layers so as to be overlaid on the fourth layer having a seam of about 2 mm. In this case, the seam thus prepared by melt-adhesion has a property (such as expansion and contraction ratio) different from that of the other portions of the fourth layer. Therefore, even when the thickness of the seam is the same as that of the other portions, the PLD of the belt at the seam is largely different from that of the other portions of the belt. Therefore, the moving speed of the belt varies when the seam portion of the belt is located on a support roller, even if the thickness of the belt does not change at the seam.

Since seamless belts are prepared using respective dies because the length of the belts is different, the manufacturing costs are high. However, seam belts can be prepared without using a die, and therefore seam belts have low manufacturing costs.

The present invention can be used for such seam belts.

Next, controlling drive of the intermediate transfer belt 11, which is one of the feature of the present invention, will be explained by reference to FIG. 5. In the copier A illustrated in FIG. 5, the intermediate transfer belt 11 is preferably moved at a constant speed. However, in reality the moving speed of the belt varies due to variation of parts in size, and environmental conditions, and deterioration of parts after repeated use.

When the moving speed of the belt 11 varies, the position of a point of the belt becomes different from the target position, and thereby the color toner images on the photoreceptors 40 are transferred onto positions of the intermediate transfer belt 11 different from the target positions, resulting in formation of a misaligned color toner image on the intermediate transfer belt. In addition, when the moving speed of the belt is relatively fast, the resultant transferred toner image has a form so as to be extended in the circumferential direction of the belt. In contrast, when the moving speed is relatively slow, the resultant transferred toner image has a form so as to be shrunk in the circumferential direction of the belt. When the moving speed is thus changed, the resultant image becomes a stripe image (banded image) having high and low image density image portions at regular intervals in the circumferential direction of the belt.

Hereinafter, the structure and performance of the intermediate transfer belt for use in the belt device of the present invention, which can be fed at a constant speed with high precision, will be explained. The following explanation is not limited to the intermediate transfer belt 11, and can apply to driving of other belts. Therefore, the following explanation will be performed using simple terms of "belt" and "roller" instead of specific terms such as "intermediate transfer belt" and "driving or driven roller". Specifically, the rotation angular velocities $\omega_1$ and $\omega_2$ of the two rollers are continuously measured, and then the PLD variation $f(t)$ of the belt is determined on the basis of the angular velocities. In this regard, when a single-layered belt is used, the PLD is related to the thickness of the belt, and therefore the PLD variation has a certain relationship with the belt thickness variation. Therefore, it is possible to determine the belt thickness variation from the two angular velocities $\omega_1$ and $\omega_2$.

The PLD variation $f(t)$ is a periodic function having a period in which the belt rotates by one revolution and representing the relationship between the PLD of portions of the belt and the time when the portions pass a reference point on the passage of the belt. Since the PLD variation $f(t)$ largely influences the belt moving speed V of the belt, the moving speed V can be precisely controlled by controlling drive of the belt on the basis of the PLD variation.

Figure 7:
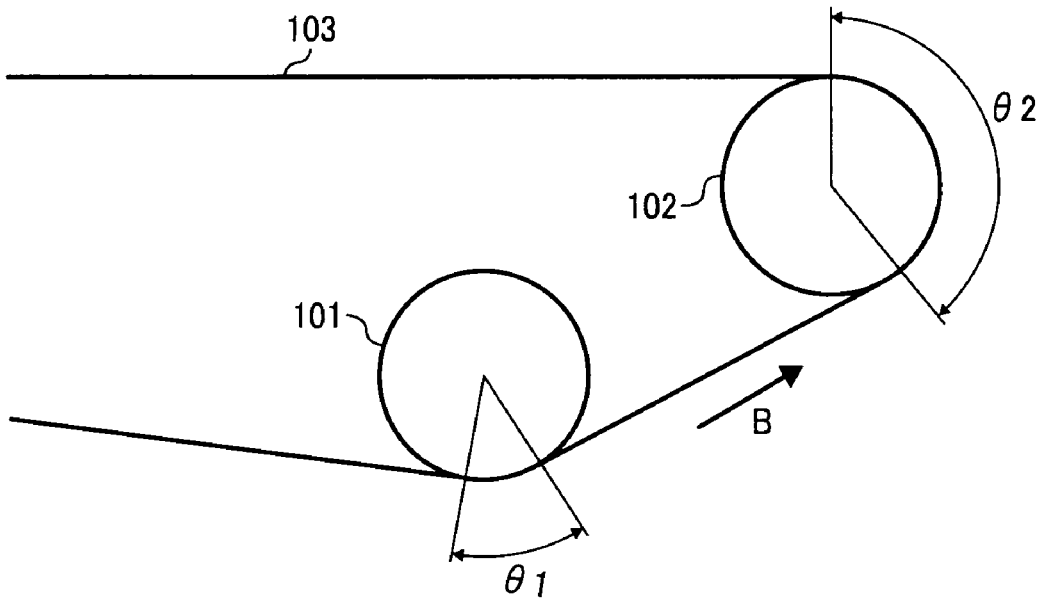
FIG. 7 is a schematic view illustrating the main portion of an example of the belt device of the present invention.

FIG. 7 is a schematic view illustrating the main portion of the belt device of the present invention. Referring to FIG. 7, the belt device includes a belt 103, and first and second rollers 101 and 102, over which the belt 103 is looped. The belt 103 has belt contact angles θ1 and θ2 against the rollers 101 and 102, respectively.

The belt 103 make an endless movement in a direction B. Rotary encoders (not shown) are provided for the rollers 101 and 102 to measure the rotation angular displacement or rotation angular velocity of the rollers. In this example, rotary encoders capable of measuring the rotation angular velocities $\omega_1$ and $\omega_2$ of the rollers are used. Specific examples of the encoders include optical encoders. Specifically, a transparent disc made of glass or a plastic, on which timing marks are formed on a concentric circle at regular intervals, is set to each of the rollers so as to be coaxial with the roller. The timing marks are optically detected with a sensor.

Alternatively, a magnetic encoder including a magnetic disc having magnetically detectable timing marks thereon can also be used. The magnetic disc is set on each of the rollers so as to be coaxial with the roller, and the timing marks are magnetically detected with a magnetic head.

Alternatively, known tachogenerators can also be used for the encoder.

In this example, the intervals of the pulses continuously output from a rotary encoder are measured and then the inverse numbers of the intervals are obtained, resulting in determination of the rotation angular velocity of a roller. The rotation angular displacement can be determined by counting the number of the continuously output pulses.

The relationships between the rotation angular velocities $\omega_1$ and $\omega_2$ of the first and second rollers 101 and 102 and the belt moving speed V are represented by the following equations (3) and (4):

$$V=\{R_1+k_1f(t)\}\omega_1 \quad (3), \text{ and}$$

$$V=\{R_2+k_2f(t-\tau)\}\omega_2 \quad (4).$$

In equations (3) and (4), V represents the belt moving speed, $R_1$ and $R_2$ represent the effective radiuses of the first and second roller 101 and 102, and $\omega_1$ and $\omega_2$ represent the rotation angular velocities of the first and second rollers 101 and 102, respectively. In addition, $k_1$ and $k_2$ represent the PLD variation effective coefficients of the first and second rollers 101 and 102, respectively. The PLD variation effective coefficients change depending on the variables such as belt contact angle (θ1 and θ2), materials constituting the belt, and structure of the belt.

The reason for setting different coefficients $k_1$ and $k_2$ is that there is a case where the degree of influence of the PLD variation on the relationship between the belt moving speed and the rotation angular velocities of the two rollers is different. This difference is caused by the differences of the two rollers in curvature of the belt on the rollers, and the belt contact angle. When the belt is a single-layered belt made of a uniform material, and the belt contact angles (θ1 and θ2) are fully larger, the coefficients $k_1$ and $k_2$ are almost the same.

As mentioned above, the PLD variation function $f(t)$ is a periodic function having a period in which the belt is rotated by one revolution and representing the relationship between the PLD of portions of the belt and the time when the portions pass a reference point on the passage of the belt. In other words, the PLD variation function represents the deviation from the average ($PLD_{ave}$) of the PLD per one revolution of the belt in the circumferential direction thereof. In this example, the reference point is the point at which the belt starts to be contacted with the first roller 101. Therefore, when t=0, the PLD variation of the portion of the belt contacted with the first roller 101 is $f(0)$. As mentioned above, the PLD variation function $f(t)$ (time function) can be replaced with the above-mentioned function $f(d)$. The functions $f(t)$ and $f(d)$ are convertible with each other.

In equation (4), τ represents the average time needed for the belt to move from the first roller 101 to the second roller 102. The time τ is hereinafter referred to as a delay time. The delay time represents the difference in phase between the PLD variation $f(t)$ at the first roller and the PLD variation $f(t-\tau)$ at the second roller.

It is difficult to determine the PLD average ($PLD_{ave}$) on the basis of the layer structure of the belt and the materials constituting the layers of the belt. However, the PLD average can be determined, for example, by performing a driving test of the belt and measuring the average moving speed of the belt. Specifically, when the belt is rotated while rotating the driving roller at a constant angular velocity, the average moving speed $V_{ave}$ of the belt is represented by the following equation (5):

$$V_{ave}=\{(r+PLD_{ave})\times\omega_{01}\} \quad (5),$$

wherein r represents the radius of the driving roller, and $\omega_{01}$ represents the constant angular velocity of the driving roller.

When the driving test mentioned above is performed, the average belt moving speed $V_{ave}$ can be determined by dividing the circumferential length of the belt by the time taken for moving the belt by one revolution. Since the circumferential length of the belt and the time can be precisely measured or timed, the average belt moving speed can be precisely determined. In addition, the $PLD_{ave}$ can be determined from equation (5) because the radius r and $\omega_{01}$ can be measured. The method for determining the $PLD_{ave}$ is not limited to this method.

At a time t, the moving speed V of a portion of the belt contacted with the second roller 102 is the same as the moving speed V of a portion of the belt contacted with the first roller 101. Therefore, the following equation (6) can be obtained from equations (3) and (4).

$$\omega_2=\{R_1+k_1f(t)\}\omega_1/\{R_2+k_2f(t-\tau)\} \quad (6).$$

Since the PLD variation $f(t)$ is much smaller than the roller effective radiuses $R_1$ and $R_2$, equation (6) can be changed to the following approximate expression (7):

$$\omega_2\approx R_1\omega_1/R_2+(R_1\omega_1/R_2)\{k_1f(t)/R_1-k_2f(t-\tau)/R_2\} \quad (7)$$

Next, the method for precisely determining the PLD variation $f(t)$ from the rotation angular velocities $\omega_1$ and $\omega_2$ of the rollers 101 and 102 will be explained. Although the diameters of the rollers 101 and 102 are the same in this example, the method can be applied to a case where the diameters are different.

The relationship between the rotation angular velocities $\omega_1$ and $\omega_2$ is represented by equation (7). Equation (7) can be changed to the following equation (8):

$$(\omega_2-R_1\omega_1/R_2)R_2/\omega_1k_1=\{f(t)-k_2R_1f(t-\tau)/k_1R_2\} \quad (8).$$

When the difference between the rotation angular velocities of the rollers 101 and 102 is standardized so that the coefficient of the function $f(t)$ is 1, and the right side member of equation (8) is defined as $gf(t)$, the following equation (9) is obtained.

$$gf(t)=\{f(t)-Gf(t-\tau)\} \quad (9),$$

wherein $G=k_2R_1/k_1R_2$.

Since G is $k_2R_1/k_1R_2$, G is a constant. In this case, the effective radiuses R of the rollers, and effective coefficients k are adjusted so that G=1. In addition, it is clear from equation (8) that $gf(t)$ can be determined from the difference between the rotation angular velocities $\omega_1$ and $\omega_2$ using the effective radiuses $R_1$ and $R_2$, and PLD variation effective coefficients $k_1$ and $k_2$. The PLD variation $f(t)$ can be determined from the function $gf(t)$.

The function $gf(t)$ is a periodic function having a period in which the belt rotates by revolution. By sampling the rotation angular velocities $\omega_1$ and $\omega_2$ for a time during which the belt rotates by one or more revolutions, the $gf(t)$ can be determined.

Next, the PLD variation determining method, in which the PLD variation $f(t)$ is determined from the function $gf(t)$ (i.e., rotation information), which can be determined from the rotation angular velocities $\omega_1$ and $\omega_2$ will be explained. In this application, three different PLD variation determining methods will be explained.

Figure 8:
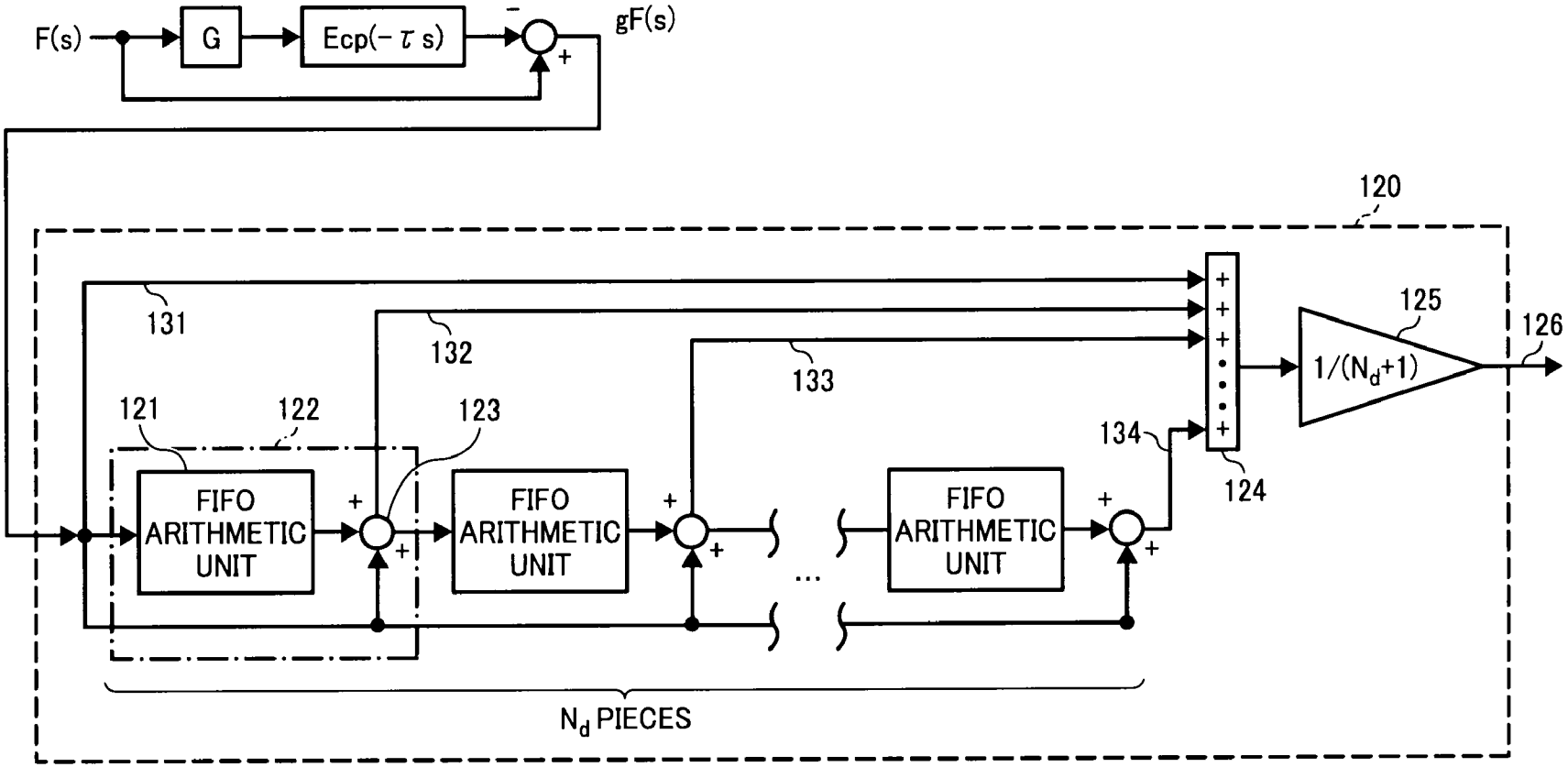
FIG. 8 is a block diagram for explaining the first method for determining the pitch line distance (PLD) variation.

FIG. 8 is a block diagram for explaining the first PLD variation determining method. In FIG. 8, a function F(s), which is obtained by subjecting the time function $f(t)$ to Laplace transform, is used. In this regard, the character s is a Laplace operator. Namely, F(s) is represented as follows.

$$F(s)=L\{f(t)\},$$

wherein $L\{f(t)\}$ represents that $f(t)$ is subjected to Laplace transform.

Referring to FIG. 8, the upper portion (from F(s) to gF(s)) represents equation (9), and numeral 120 represents a filter, which is surrounded by a dotted line and which extracts the PLD variation $f(t)$ from the difference between the rotation angular velocities $\omega_1$ and $\omega_2$.

Figure 9:
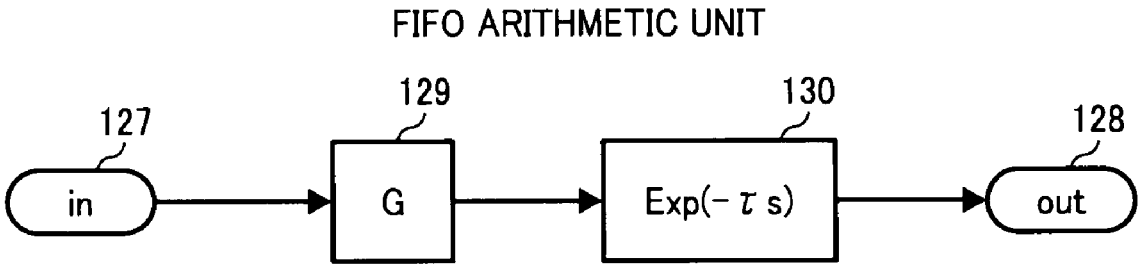
FIG. 9 is a block diagram for explaining the FIFO arithmetic unit illustrated in FIG. 8.
Figure 10:
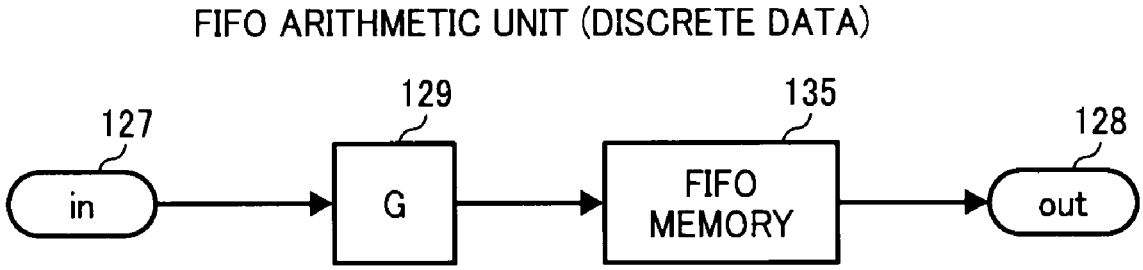
FIG. 10 is a block diagram prepared by subjecting the block diagram of FIG. 9 to Z-transformation.

FIG. 9 is a block diagram used for explaining the processing of a FIFO arithmetic unit 121 illustrated in FIG. 8, and FIG. 10 is a block diagram illustrating the Z-transformed version of the block diagram illustrated in FIG. 9.

Referring to FIGS. 8-10, the FIFO arithmetic unit 121 at first obtains the product of an input data 127 and a gain G in a block 129. In this regard, when the roller diameters are the same, G is 1. However, G can be adjusted in consideration of variation of the roller diameter due to changes of environmental conditions and abrasion of the rollers by the belt after long repeated use.

Next, in a block 130 a phase delay corresponding to the phase difference (τ) of the PLD variation between the rollers 102 and 101 is added, and the data are output to a block 128. In this regard, when digital signal processing is performed, the input data 127 are discrete data. As mentioned above, the block diagram illustrated in FIG. 10 is a Z-transformed version of the block diagram illustrated in FIG. 9. A block 135 illustrates a FIFO (First-In-First-Out) memory configured to store the data concerning the phase difference ($\tau$) of the PLD variation.

The FIFO memory 135 stores the input data, and output a $\tau d$ pieces of past data, wherein $\tau d$ is a natural number. Thus, each FIFO arithmetic unit 121 includes one FIFO memory and one gain. For example, when the input data have a sampling period of Ts, $\tau$ is equal to ($\tau d \times Ts$).

In the filter 120 illustrated in FIG. 8, plural FIFO arithmetic units are serially connected. A step 122 surrounded by a chain line in FIG. 8 is a first step in which the processing performed by the FIFO arithmetic unit 121 and the processing performed by an adder 123 are performed. In this regard, when the time needed for the belt 103 to rotate by one revolution is Tb, Tb is equal to N×Ts, wherein N represents the number of sampling operations performed per one revolution of the belt, and is a natural number.

The filter 120 determines the PLD variation $f(t)$ from the N-pieces of data rows obtained every sampling time Ts. In this regard, the filtering processing in the filter 120 is digital processing and can be performed by a DSP (digital signal processor) or micro CPU.

When the data gF(s), which is data concerning the left side member of equation (8) and which can be obtained from the rotation angular velocities $\omega_1$ and $\omega_2$ are input to the filer 120, an output 132 of the first step is a time function h1($t$) of H1($s$), i.e., L−1{H(s)}, wherein L−1 {H(s)} represents that H(s) is subjected to inverse Laplace transform. Similarly, an output 133 of the second step is a time function i1($t$) of I1($s$), and an output 134 of the n-th step is a time function j1($t$) of J1($s$). These are represented by the following equations (10-1) to (10-3):

$$\begin{aligned} h_1(t) &= [gf(t) + Ggf(t-\tau)] \\ &= f(t) - Gf(t-\tau) + G[f(t-\tau) - Gf(t-2\tau)] \\ &= f(t) - G^2 f(t-2\tau) \end{aligned} \tag{10-1}$$

$$\begin{aligned} i_1(t) &= [gf(t) + Gh_1(t-\tau)] \\ &= f(t) - Gf(t-\tau) + G[f(t-\tau) - G^2 f(t-3\tau)] \\ &= f(t) - G^3 f(t-3\tau) \end{aligned} \tag{10-2}$$

$$\begin{aligned} j_1(t) &= f(t) - Gf(t-\tau) + G[f(t-\tau) - G^n f(t-(n+1)\tau)] \\ &= f(t) - G^{n+1} f(t-(n+1)\tau) \end{aligned} \tag{10-3}$$

Referring to FIG. 8, an adder block 124 adds the data output at the steps of from the zero step (i.e., $gf(t)$) to the n-th step to obtain added data $Sum_1$. The added data $Sum_1$ are represented by the following equation (11):

$$\begin{aligned} Sum_1 = (n+1)f(t) - Gf(t-\tau) - G^2 f(t-2\tau) - G^3 f(t-3\tau) - \ldots \\ - G^{n-1} f(t-(n+1)\tau) \end{aligned} \tag{11}$$

In equation (11), the PLD variation $f(t)$, i.e., the first term of equation (11), is multiplied by (n+1), and the PLD variations of the other terms, $f(t-m\tau)$, have different phases and are dispersed at regular phase intervals. In this regard, m is a natural number. In addition, when G is 1, the magnitudes of the PLD variations of theses terms are the same. Therefore, it is possible to determine the number of steps such that some of the terms $f(t-m\tau)$ cancel each other.

In this filtering processing, processings at the Nd steps are connected, and therefore division by (Nd+1) is performed in a division block 125. Thus, the PLD variation $f(t)$ can be determined. The results of the processing at the adder block 125 are as follows:

$$\begin{aligned} \frac{Sum_1}{(Nd+1)} &= f(t) - \frac{\left\{ \begin{array}{c} Gf(t-\tau) + G^2 f(t-2\tau) + \\ G^3 f(t-3\tau) + \ldots + \\ G^{Nd+1} f(t-Nd+1)\tau \end{array} \right\}}{(Nd+1)} \\ &\approx f(t) \end{aligned} \tag{12}$$

Thus, the PLD variation $f(t)$ can be determined. In this regard, the error is the second term of the right side member of equation (12) (i.e., $\{Gf(t-\tau) + \ldots + G^{Nd+1} f(t-(Nd+1)\tau)\}/(Nd+1)$). Since division by (Nd+1) is performed in the second term, the value thereof is much smaller than the PLD variation $f(t)$. Therefore, by increasing the number of the processing steps, the error can be neglected.

According to the below-mentioned sequence, in which the above-mentioned results are generalized, the PLD variation $f(t)$ is determined from the left side member of equation (9) using the rotation angular velocities $\omega_1$ and $\omega_2$ detected. By using this method, the PLD variation $f(t)$ can be precisely determined.

Specifically, in the first step, $gf(t)$ is added with data, which are obtained by multiplying $gf(t)$ by G and delaying the time by $\tau$, to obtain g1($t$). In the second step, $gf(t)$ is added with data, which are obtained by multiplying g1($t$) by G and delaying the time by $\tau$, to obtain g2($t$). In the third step, $gf(t)$ is added with data, which are obtained by multiplying g2($t$) by G and delaying the time by $\tau$, to obtain g3($t$). In the n-th step, $gf(t)$ is added with data, which are obtained by multiplying gn−1(t) by G and delaying the time by $\tau$, to obtain gn(t). In the final step, the data obtained at the steps of from the zero-step (i.e., $gf(t)$) to the n-th step are added and then the data are divided by (n+1). Thus, the PLD variation can be determined.

In the filter 120 illustrated in FIG. 8, Nd pieces of the same processing steps are connected in parallel. In this processing step, the data (i.e., $gf(t)$) (or signals) input to this processing (i.e., the data obtained at the last step) are processed so as to include the delay time element $\tau$ and the gain element G, and the thus obtained data are added with the data (or signals) input to the filer. In addition, the data obtained in each step (including the zero-step data) input to the filter 120 are added and the added data are divided by (Nd+1). Thus, the PLD variation $f(t)$ can be determined. The proper number of the steps (i.e., Nd) at which precision in determining the PLD variation can be enhanced will be explained later.

In FIG. 8, a line 131 represents an output which is output to the adder block 124 without passing through the processing steps, and the line 132 represents an output which is output to the adder block 124 through the processing step 122. In addition, the line 133 represents an output, which is output from the next processing step to the adder block 124. The line 134 represents an output, which is output from the last processing step to the adder block 124. Numeral 126 denotes an output from the filter 120.

Figure 11:
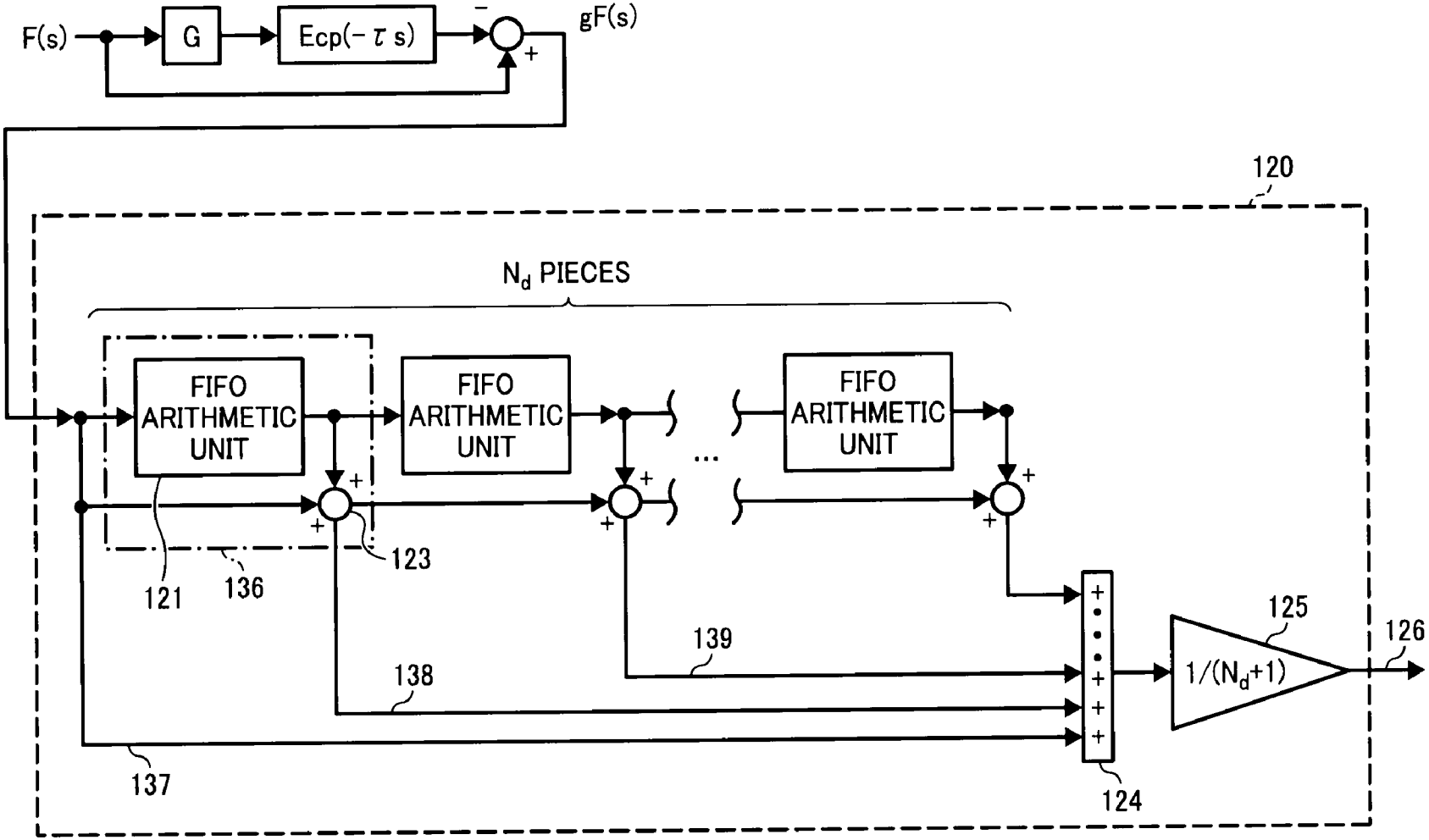
FIGS. 11 and 12 are block diagrams for explaining the second and third methods for determining the pitch line distance (PLD) variation.

FIG. 11 is a block diagram used for explaining the second PLD variation determining method. This second method is a modified version of the first PLD variation determining method mentioned above. The data gF(s), i.e., the left side member of equation (8) (i.e., data obtained from the rotation angular velocities $\omega_1$ and $\omega_2$ detected), are input to the filter 120 illustrated in FIG. 11. In this regard, a function h2($t$), which is a time function of H2($s$) which is an output 138 at the first step, a function i2($t$), which is a time function of I2($s$) which is an output 139 at the second step, and a function j2($t$), which is a time function of J2($s$) which is an output at the n-th step are represented by the following equations (13-1) to (13-3).

$$\begin{aligned} h_2(t) &= [gf(t) + Ggf(t-\tau)] \\ &= f(t) - Gf(t-\tau) + G[f(t-\tau) - Gf(t-2\tau)] \\ &= f(t) - G^2 f(t-2\tau) \end{aligned} \tag{13-1}$$

$$\begin{aligned} i_2(t) &= [h_2(t) + G^2 gf(t-2\tau)] \\ &= f(t) - G^2 f(t-2\tau) + G^2[f(t-2\tau) - Gf(t-3\tau)] \\ &= f(t) - G^3 f(t-3\tau) \end{aligned} \tag{13-2}$$

$$\begin{aligned} j_2(t) &= [i_2(t) + G^n gf(t-(n+1)\tau)] \\ &= f(t) - G^{n+1} f(t-(n+1)\tau) \end{aligned} \tag{13-3}$$

Referring to FIG. 11, the adder block 124 adds the data output at the steps of from the zero-step (i.e., gf(t)) to the n-th step to obtain added data $Sum_2$. The added data $Sum_2$ are represented by the following equation (14):

$$\begin{aligned} Sum_2 = (n+1)f(t) - Gf(t-\tau) - G^2 f(t-2\tau) - G^3 f(t-3\tau) - \ldots \\ - G^{n+1} f(t-(n+1)\tau) \end{aligned} \tag{14}.$$

In this filtering processing, processings at the Nd steps are connected, and therefore division by (Nd+1) is performed in the division block 125. Thus, the PLD variation f(t) can be determined similarly to the above-mentioned first method using equation (12).

According to the below-mentioned sequence in which the above-mentioned second method is generalized, the PLD variation f(t) is determined from the left side member of equation (9) using the rotation angular velocities $\omega_1$ and $\omega_2$ detected. By using this method, the PLD variation f(t) can be precisely determined.

Specifically, in the first step, gf(t) is added with the data, which are obtained by multiplying gf(t) by G and delaying the time by τ, to determine g1($t$). In the second step, gf(t) is added with the data, which are obtained by multiplying g1($t$) by G and delaying the time by τ, to determine g2($t$). In the third step, gf(t) is added with the data, which are obtained by multiplying g2($t$) by G and delaying the time by τ, to determine g3($t$). In the n-th step, gf(t) is added with the data, which are obtained by multiplying gn−1(t) by G and delaying the time by τ, to determine gn(t). In the final step, the data obtained at the steps of from the zero-step (i.e., gf(t)) to the n-th step are added and then the added data are divided by (n+1). Thus, the PLD variation can be determined.

In FIG. 11, a line 137 represents an output which is output to the adder block 124 without passing through the processing steps, and a line 138 represents an output which is output to the adder block 124 through a processing step 136. In addition, a line 139 represents an output, which is output from the next processing step to the adder block 124. Numeral 126 denotes an output from the filer 120.

Next, the proper number of steps at which the PLD variation f(t) can be precisely determined will be explained. The following equation (15) is obtained by generalizing the PLD variation f(t) (i.e., the output 126 in FIGS. 8 and 11) determined by the first and second PLD variation determining methods.

$$f(t) \approx f(t) - \frac{1}{N_d+1} \sum_{n=1}^{N_d+1} G^n f(t-n\tau) \tag{15}$$

The second term of equation (15) is the error component when the PLD variation f(t) is determined. In the second term of equation (15), (Nd+1) pieces of variable components, which are obtained at the (Nd) steps and which are different in initial phase by τ, are superimposed. This method utilizes the property such that the PLD variation f(t), which is to be determined, is added while having the same phase, but the other terms (i.e., f(t−τ)), which are to be deleted, have different phases and are dispersed.

Therefore, it is preferable that the initial phases of the variable components in the second term of equation (15) are evenly dispersed in the belt rotation phase range of from 0 radian to 2π radian (i.e., one revolution of the belt). When the variable components are evenly dispersed, some components cancel each other, and thereby the error component can be decreased. In addition, since the second term of equation (15) is further divided by Nd+1, the error can be further decreased. When the phase difference between the two rollers is τ' radian, the number of the steps, which make even dispersion, is obtained from the following equation 16:

$$\tau'(Nd+1) = 2\pi m \tag{16},$$

wherein m is a natural number.

For example, when the phase difference τ' is 0.52 radian, the proper number of steps Nd is 11 if m=1. Namely, it is preferable to connect in parallel 11 pieces of the processing step 122 or 136 surrounded by the chain line in FIG. 8 or 11. In this case, the error component can be evenly dispersed in the PLD variation filtering processing, and thereby the precision at the extraction filtering processing of the PLD variation f(t) can be dramatically improved.

In the PLD variation determining method, by performing the above-mentioned processing, one of two pieces of the rotation variation information is added while the phase thereof is identified with that of the other information, and therefor the rotation variation information has a large value. By performing drive controlling to remove the variation, precise drive controlling can be performed.

Figure 12:
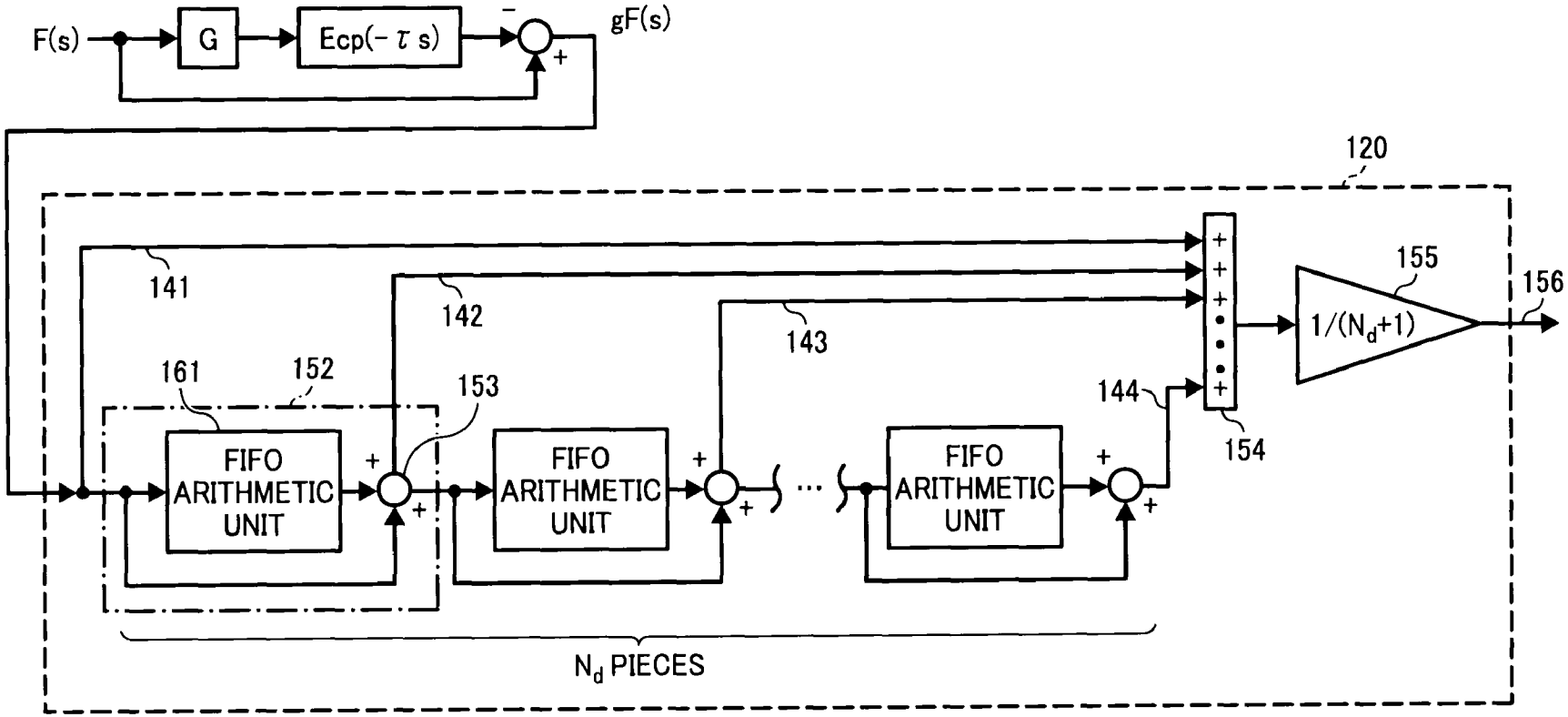
Figure 13:
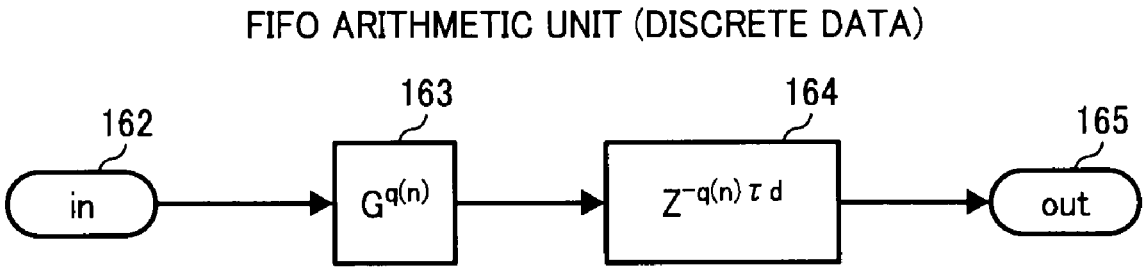
FIG. 13 is a block diagram prepared by subjecting the block diagram of FIG. 12 to Z-transformation.

FIG. 12 is a block diagram used for explaining the third PLD variation determining method. FIG. 13 is a block diagram illustrating a Z-transformed version of the block diagram illustrated in FIG. 12.

In the third method, the data gF(s), i.e., the left side member of equation (8) (i.e., data obtained from the rotation angular velocities $\omega_1$ and $\omega_2$ detected), are input to the filter 120 illustrated in FIG. 12. In this regard, a function h3($t$), which is a time function of H3($s$) which is an output 142 at a first processing step surrounded by a chain line and including a FIFO arithmetic unit 152 and an adder 153, a function i3($t$), which is a time function of I3($s$) which is an output 143 at the second step, and a function j3($t$), which is a time function of J3($s$) which is an output 144 at the n-th step, are represented by the following equations (17-1) to (17-3).

$$\begin{aligned} h_3(t) &= [gf(t) + Ggf(t-\tau)] \\ &= f(t) - Gf(t-\tau) + G[f(t-\tau) - Gf(t-2\tau)] \\ &= f(t) - G^2 f(t-2\tau) \end{aligned} \tag{17-1}$$

-continued $$i_3(t) = [h_3(t) + G^2 h_3(t-2\tau)] \tag{17-2}$$
$$= f(t) - G^2 f(t-2\tau) + G^2[f(t-2\tau) - G^2(t-4\tau)]$$
$$= f(t) - G^4 f(t-4\tau)$$

$$j_3(t) = \left[i_3(t) + G^{2^{n-1}} gf(t-2^{n-1}\tau)\right] \tag{17-3}$$
$$= f(t) - G^{2^{n-1}} f(t-2^{n-1}\tau)$$

Referring to FIG. 12, an adder block 154 adds the data output at the steps of from the zero step (i.e., gƒ(t)) to the n-th step to obtain added data $Sum_3$. The added data $Sum_3$ are represented by the following equation (18):

$$Sum_3=(n+1)f(t)-Gf(t-\tau)-G^2f(t-2\tau)-G^4f(t-4\tau)- \ldots -G^{2n-1}f(t-2^{n-1}\tau) \tag{18}.$$

In this filtering processing, processings at the Nd steps are connected, and therefore division by (Nd+1) is performed in a division block 155. Thus, the PLD variation ƒ(t) can be determined. A FIFO arithmetic unit 161 for use in the third method is illustrated in FIG. 13. In this regard, the gain and delay are different at the steps. In FIG. 13, q=2n−1.

According to the below-mentioned sequence in which the above-mentioned third method is generalized, the PLD variation ƒ(t) is determined from the left side member of equation (9) using the rotation angular velocities $\omega_1$ and $\omega_2$ detected. By using this method, the PLD variation ƒ(t) can be precisely determined.

Specifically, in the first step, gƒ(t) is added with the data, which are obtained by multiplying gƒ(t) by G and delaying the time by τ, to obtain g1(*t*). In the second step, gƒ(t) is added with the data, which are obtained by multiplying g1(*t*) by $G^2$ and delaying the time by 2τ, to obtain g2(*t*). In the third step, gƒ(t) is added with the data, which are obtained by multiplying g2(*t*) by $G^4$ and delaying the time by 4τ, to obtain g3(*t*). In the n-th step, gƒ(t) is added with data, which are obtained by multiplying gn−1(t) by $G^{2n-1}$ and delaying the time by $(2^{n-1})$, to determine gn(t). In the final step, the data obtained at the steps of from the zero-step (i.e., gƒ(t)) to the n-th step are added and then the added data are divided by (n+1). Thus, the PLD variation can be determined.

In FIG. 12, a line 141 represents an output which is output to the adder block 154 without passing through the processing steps, and the line 142 represents an output which is output to the adder block 154 through the processing step 152. In addition, the line 143 represents an output, which is output from the next processing step to the adder block 154. The line 144 represents an output, which is output from the last processing step to the adder block 154. Numeral 156 denotes an output from the filer 120.

Referring to FIG. 13, the product of input data 162 and gain G is obtained in a block 163. A block 164 is a FIFO memory configured to store the data concerning the phase difference (r) of the PLD variation. Numeral 165 denotes an output from the filter 120.

The following equation (19) is obtained by generalizing the PLD variation ƒ(t) (i.e., the output 156 in FIG. 12) determined by the third methods.

$$f(t) \approx f(t) - \frac{1}{N_d+1}\sum_{n=1}^{N_d+1} G^{2^{n-1}} f(t-2^{n-1}\tau) \tag{19}$$

The second term of equation (19) is the error component when the PLD variation ƒ(t) is determined. In the second term of equation (19), (Nd+1) pieces of variable components, which are obtained at the (nd) steps and which are different in initial phase by τ, are superimposed. This method utilizes the property such that the PLD variation ƒ(t), which is to be determined, is added while having the same phase, but the other terms (i.e., ƒ(t−τ)), which are to be deleted, have different phases and are dispersed. As mentioned above, the proper number of steps is determined so that even dispersion effect can be obtained.

As mentioned above, the rotation angular velocities $\omega_1$ and $\omega_2$ of the two rollers 101 and 102 illustrated in FIG. 7 are influenced by the PLD variation ƒ(t) and ƒ(t−τ), respectively. However, the present inventors discover that by using the above-mentioned arithmetic algorithm in the filtering processing, the PLD variation ƒ(t) can be precisely determined without depending on the frequency characteristic.

In the PLD variation determining method of the present invention, determination errors are caused. Since the errors largely depend on the number Nd of steps, the proper number of steps is determined such that variation in the belt moving speed falls within a target range (allowable range). The method for determining the number Nd is as follows.

In general, variation of the belt moving speed is caused not only by the PLD variation but also by other variations such as eccentricity of driving gears for driving the driving roller, and cumulative errors of the gears. Therefore, the variation of the belt moving speed caused by the PLD variation has to fall within its own target range, which is allocated for the variation in consideration of other variations, so that the variation of the belt moving speed falls within a target range even when taking the PLD variation and the other variations (such as variation of driving gears) into consideration.

When the moving speed of the intermediate transfer belt 11 of the copier A illustrated in FIG. 5 is varied, problems in that misaligned color images are formed and banded images are formed are caused. The problems are caused because the position at which the intermediate transfer belt receives a toner image is different from the target position due to variation of the moving speed of the intermediate transfer belt. In this regard, the greater the difference in position (i.e., the greater the variation of the moving speed), the worse the problems become.

Since misaligned images and banded images are noticed by human eyes, the tolerance levels thereof can be determined, for example, by performing sensory evaluation tests. For example, banded images can be evaluated using the spatial frequency fs representing the distance between a stripe image to adjacent stripe image.

The spatial frequency fs and the time frequency f have the following relationship:

$$f=F\times fs,$$

wherein F is a constant.

Therefore, the allowable range of the difference in position of the belt can be determined from the allowable range of the spatial frequency. In addition, the allowable range of the variation of the belt moving speed can also be determined from the allowable range of the difference in position of the belt.

In the third PLD variation determining method mentioned above, by performing the above-mentioned processing, one of two pieces of the rotation variation information is added while the phase thereof is the same, and therefor the rotation variation information has a large value. Therefore, the one of two pieces of rotation variation information can be obtained. By performing drive controlling to remove the thus determined variation, precise drive controlling can be performed.

Next, the method for controlling the belt moving speed (i.e., belt driving) using the PLD variation determined above will be explained.

Several belt driving methods using the PLD variation $f(t)$ can be used for controlling the belt moving speed. Among the methods, a first belt drive controlling method using a device configured to detect the home position of the belt 103 illustrated in FIG. 7, and a second belt drive controlling method which does not use such a device will be explained in this application.

In the first belt drive controlling method, the phase (i.e., the phase determined when the one circuit of the belt is $2\pi$ radian) of the PLD variation at a position of the belt 103 has to be determined in order to perform proper belt driving using the PLD variation. In this first belt driving method, a home position mark (i.e., a reference mark) is formed on a predetermined point of the belt so as to be detected with a sensor. The phase can be determined utilizing time information which is obtained by measuring the time from detection of the home position using a timer, or by obtaining information on the rotation angle of the driving motor, or information on the rotation angle obtained by the output from a rotary encoder.

Figure 14:
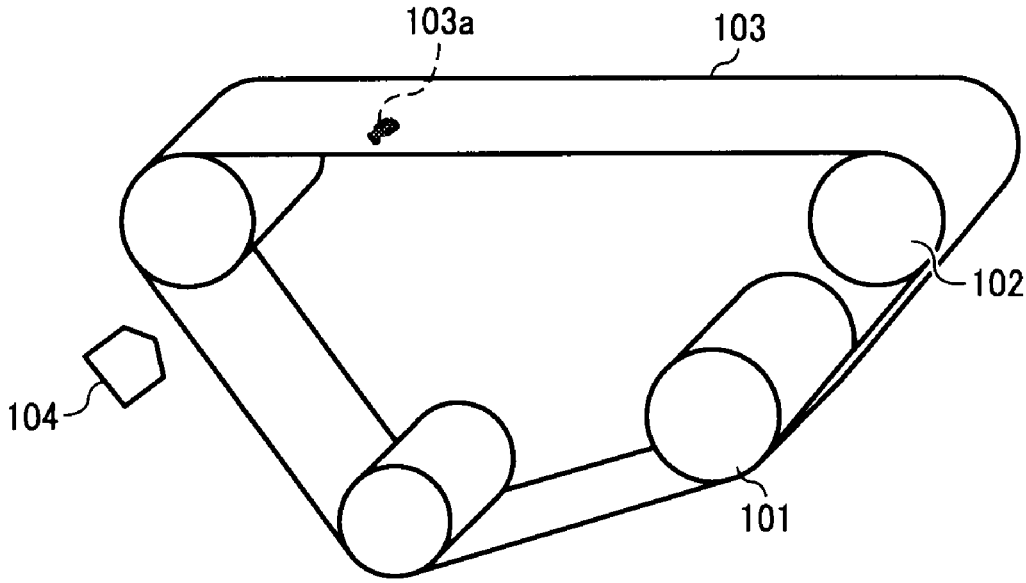
FIG. 14 is a schematic view for explaining the configuration of a device configured to detect a home position mark formed on a belt.

FIG. 14 is a schematic view illustrating a device for use in the first belt drive controlling method and for detecting a home position mark formed on a belt. Referring to FIG. 14, a home position mark 103*a* is formed on a point of the surface of the belt 103. A mark sensor 104 detects the home position mark 103*a*, which results in determination of the reference phase per one revolution of the belt.

In this example, the home position mark 103*a* is made of a metal film, and the mark sensor 104 is a reflection photosensor, which is fixed on a fixed member. The mark sensor 104 outputs a pulse signal when the mark 103*a* passes through the detection area of the mark sensor. It is preferable to form the mark 103*a* on an inner surface of the belt 103 or on a side edge of the outer surface of the belt so that the mark does not adversely affect image formation.

It is possible that an image forming material such as toner and ink is adhered to the surfaces of the mark 103*a* and the sensor 104. In this case, a problem in that the mark 103*a* cannot be properly detected occurs. Therefore, it is preferable for the sensor 104 to have a function of detecting the mark while controlling the sensor output amplitude, pulse width and pulse interval. In general, one home position mark is formed, but plural marks may be formed as the home position mark to prevent mis-detection of a home position mark.

Figure 15:
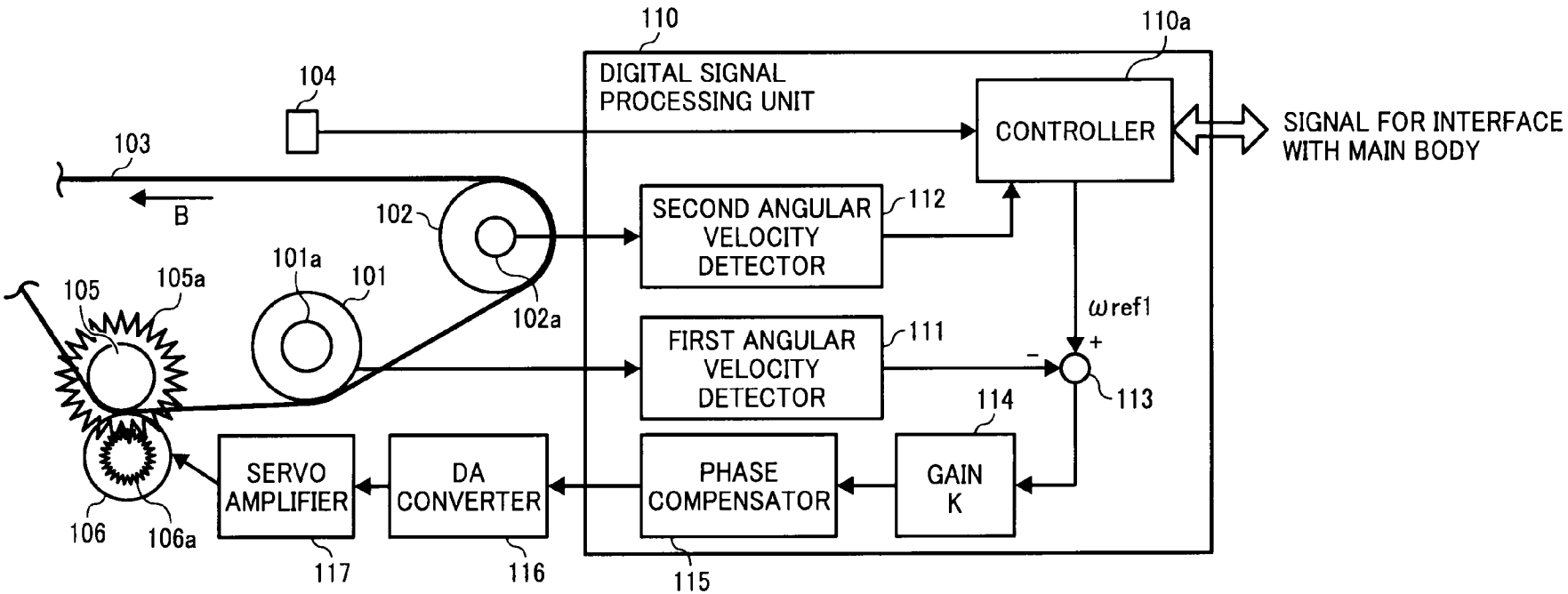
FIG. 15 is a schematic view for explaining a first example of the belt drive controlling operation.

FIG. 15 is a schematic view used for explaining the control operations of the first belt drive controlling method. In FIG. 15, the mark sensor 104 is arranged at a position different from the position in FIG. 14 for convenience of explanation.

Referring to FIG. 15, the driving force generated by a driving motor 106 is transported to the driving roller 105 via a decelerator including a driving gear 106*a* and a driven gear 105*a*. Thereby, the driving roller 105 is rotated, and the belt 103 is rotated in the direction B. The first and second rollers 101 and 102 are driven rollers rotated by the belt 103.

Rotary encoders 101*a* and 102*a* are provided on the respective rollers 101 and 102. The signals output from the encoders 101*a* and 102*a* are input to first and second angular velocity detectors 111 and 112, respectively. The rotary encoders may be connected with the rollers through a decelerator, if necessary. The surfaces of the rollers 101 and 102 are subjected to a treatment and the belt contact angles of the rollers are optimized to prevent occurrence of slipping between the surfaces of the rollers and the inner surface of the belt 103.

In this first belt drive controlling method, the motor control signal, which is output from a digital signal processing unit 110 (serving as a processor) after calculation, is input to a servo amplifier through a DA converter 116. A servo amplifier 117 drives the driving motor 106 according to the motor control signal.

In the digital signal processing unit 110, the first angular velocity detector 111 determines the rotation angular velocity $\omega_1$ of the first roller 101 on the basis of the signal output from the first rotary encoder 101*a*. Similarly, the second angular velocity detector 112 determines the rotation angular velocity $\omega_2$ of the second roller 102 on the basis of the signal output from the second rotary encoder 102*a*.

A controller 110*a* determines the control target of the angular velocity $\omega_{ref1}$ by calculation on the basis of the PLD variation information of the belt 103 so that the belt moving speed is maintained so as to be identical with the target belt speed directed by the main body of the copier A.

Specifically, at first the belt 103 is driven so that the rotation angular velocity $\omega_1$ of the first roller 101 is controlled so as to be the target belt speed directed by the main body of the copier A. Namely, the belt 103 is driven so that the rotation angular velocity of the $\omega_1$ of the first roller 101 becomes constant. In this regard, the target belt speed $\omega_{ref1}$ directed by the main body is the above-mentioned rotation angular velocity $\omega_{01}$. When the rotation angular velocity $\omega_1$ of the first roller 101 becomes constant, the PLD variation $f(t)$ is determined from the rotation angular velocity $\omega_2$ of the second roller 102 on the basis of the pulse signal from the mark detection sensor 104 using the above-mentioned PLD variation determining method. In addition, the controller corrects the target angular velocity $\omega_{ref1}$ on the basis of the thus determined PLD variation $f(t)$, and outputs the corrected target angular velocity $\omega_{ref1}$.

The thus output corrected target angular velocity $\omega_{ref1}$ is compared with the rotation angular velocity $\omega_1$ of the first roller 101 by a comparator 113, and the comparator 113 outputs the deviation therefrom. The deviation is input to a gain (k) 114 and a phase compensator 115, and the phase compensator outputs a motor control signal.

The deviation input to the gain (k) 114 is the difference between the corrected target angular velocity $\omega_{ref1}$ and the detected rotation angular velocity $\omega_1$ of the first roller 101. In this example, the deviation is caused by transmission errors such as slipping of the belt from the rollers and eccentricity of the driving gears 106*a* and the driven gears 105*a*, and by variation of the belt moving speed due to eccentricity of the driving roller 105. The driving motor 106 is driven by the motor control signal such that the deviation is minimized and the belt 103 is rotated at a constant speed. Therefore, the motor signal is output after adjusted, for example, using a PID controller to minimize the deviation of the belt moving speed from the target while stabilized without overshooting and oscillation.

In order that the belt moving speed V is maintained at a constant speed $V_0$, the rotation angular velocity of the first roller 101 is controlled so as to be $\omega_1$ derived from the following equation (20).

$$V_0 = \{R_1 + k_1 f(t)\}\omega_1 \tag{20}$$

-continued $$\omega_1 = V_0/\{R_1 + k_1 f(t)\}$$
$$\approx (V_0/R_1)\{1 - (k_1/R_1)f(t)\}$$
$$= \omega_{ref1}$$

When the rotation angular velocity $\omega_2$ of the second roller 101 is controlled, the following equation (21) is used.

$$\omega_2 \approx (V_0/R_2)\{1 \times (k_2/R_2)f(t-\tau)\} = \omega_{ref2} \quad (21)$$

In the first belt drive controlling method, even when the belt 103 has a PLD variation in the circumferential direction thereof, the rotation angular velocity $\omega_1$ of the first roller 101 can be controlled so as to be the corrected target angular velocity $\omega_{ref1}$ corrected on the basis of the PLD variation $f(t)$. As a result, the variation of the belt moving speed caused by the PLD variation can be decreased.

Next, the second belt drive controlling method will be explained.

The second belt drive controlling method uses a low cost system, which does not have a home position detection mechanism, but the basic controlling operations of the second method are the same as those of the first method. Specifically, in the second belt drive controlling method, a virtual home position signal is used to determine the home position instead of the pulse signal output from the mark detection sensor 104. For example, one revolution of the belt 103 is predicted from the data concerning the accumulated rotation angles of the rollers 101 and 102, which are measured by the rotary encoders 101*a* and 102*a*.

Since the accumulated rotation angles of the rollers per one revolution of the belt can be previously determined by calculation, one revolution of the belt can be predicted by the accumulated rotation angles of the rollers. In this regard, the time, at which measurement of the accumulated rotation angle is started, is origin (i.e., t=0 in the PLD variation $f(t)$), which corresponds to the time, at which the pulse signal is received from the mark detection sensor 104, in the first belt drive controlling method.

The virtual home position signal is generated every revolution of the belt 103. The method for generating the virtual home position signal is not limited to the method mentioned above, and, for example, a method, in which one revolution of the belt 103 is predicted by measuring the accumulated angles of the driving motor 106, can also be used. The accumulated rotation angle of the motor per one revolution of the belt can be previously determined by calculation. Therefore, in the method, at the time when the accumulated rotation angle of the motor reaches the predetermined angle, a virtual home position signal is generated.

Alternatively, it is possible to use the following method. Specifically, when the belt 103 is rotated at the predetermined average moving speed, the one revolution time needed for rotating the belt by one revolution can be calculated on the basis of the average moving speed. When the time reaches the one revolution time, a virtual home position signal is generated.

In this second belt drive controlling method, the prediction of one revolution of the belt tends to have errors caused by variations of the average of the PLD (i.e., $PLD_{ave}$) variations in size of parts such as rollers, changes of environmental conditions, changes and deterioration of parts with time, etc. When the predicted one revolution of the belt is different from the real one revolution thereof, the deviation in phase of the PLD variation $f(t)$ cumulatively increases. Therefore, when the belt drive controlling is performed on the basis of the PLD variation data $f(t)$, variation of the belt moving speed is caused and increases.

This production of variation will be explained in detail. Even in the case where the PLD variation $f(t)$ is determined on the basis of the virtual home position signal, the rotation angular velocity $\omega_1$ of the first roller 101 is controlled using the target angular velocity $\omega_{ref1}$ defined in equation (20). In this case, the rotation angular velocity $\omega_2$ of the second roller 102 has to be the target angular velocity $\omega_{ref2}$ defined in equation (21). If the virtual home position signal is output at a time deviated from the real time by d, the belt moving speed $V_d$ is represented by the following equation (22):

$$V_d = \{R_1 + k_1 f(t-d)\}\omega_{ref1} \quad (22).$$

By substituting equation (20) into equation (22), the following equation (23) can be obtained.

$$V_d \approx V_0\{1 + (k_1/R_1)(f(t-d) - f(t))\} \quad (23)$$

At this time, the rotation angular velocity $\omega_{2d}$ of the second roller 102 is represented by the following equation (24):

$$\omega_{2d} = V_d/\{R_2 + k_2 f(t-\tau-d)\} \quad (24).$$

By substituting equation (23) into equation (24), the following equation (25) can be obtained.

$$\omega_{2d} \approx (V_0/R_2)\{1 - (k_2/R_2)f(t-\tau-d) + (k_1/R_1)(f(t-d) - f(t))\} \quad (25)$$

Therefore, the deviation $\omega_{2\delta}$ of the rotation angular velocity of the second roller 102 caused by the time difference d in the home position detection time is represented by the following equation (26):

$$\omega_{2\delta} = \omega_{2d} - \omega_{ref2} \quad (26).$$

Thus, the deviation $\omega_{2\delta}$ of the rotation angular velocity of the second roller 102 is the difference between the detected data $\omega_{2d}$ of the angular velocity of the second roller 102 and the reference $\omega_{ref2}$ of the angular velocity of the second roller 102.

By substituting equations (21) and (25) into equation (26), the following equation (27) can be obtained.

$$\omega_{2\delta} = (V_0/R_2)[(k_1/R_1)\{f(t-d) - f(t)\} - (k_2/R_2)\{f(t-\tau-d) - f(t-\tau)\}] \quad (27)$$

It can be understood from equation (27) that the deviation $\omega_{2\delta}$ is that the first term and the second term are superimposed. Namely, the deviation $\omega_{2\delta}$ is that the variation component of the first roller (i.e., the first term) caused by the difference of the virtual home position and the real home position by a time d, and the variation component of the second roller (i.e., the second term) caused by the difference of the virtual home position and the real home position by a time d are superimposed.

When the absolute value of the deviation $\omega_{2\delta}$ exceeds a certain value or the average, square mean value, or square root of the square mean value of the absolute value of the deviation per one revolution of the belt exceeds a certain value, the PLD variation $f(t)$ is corrected.

The correction is made as follows. While the rotation angular velocity $\omega_1$ of the first roller 101 is controlled at $\omega_{01}$, the rotation angular velocity $\omega_2$ of the second roller 102 is detected to determine a new PLD variation $f(t)$. By using this new PLD variation $f(t)$, the rotation angular velocity $\omega_1$ of the first roller is controlled so as to be $\omega_{ref1}$.

The PLD variation can be updated. The method for updating the PLD variation will be explained.

Depending on the materials constituting the belt, the PLD variation of the belt easily changes when the environmental conditions (such as temperature and humidity) change or when the belt is abraded after long repeated use. This is because the thickness of the belt is changed due to abrasion and/or the Young's modulus of the belt is changed after the belt is repeatedly expanded and contracted. In addition, when the belt 103 is replaced with a new belt, the PLD variation may change. In addition, as mentioned above there is a case where the virtual home position deviates from the real home position. In these cases, the PLD variation should be updated.

The PLD variation update methods are broadly classified into intermittent update methods and continuous update methods. The former methods include methods in which whether or not the belt drive controlling on the basis of the PLD variation is properly performed is watched, and if not, the PLD variation is updated. The latter methods include methods in which the PLD variation is periodically updated without watching the PLD variation. For example, methods in which the PLD variation is always obtained, and the PLD variation is continuously updated can be used.

Next, the method for updating the PLD variation once determined will be explained. When the PLD variation $f(t)$ is once determined precisely, the rotation angular velocity $\omega_1$ of the first roller 101 is maintained at the angular velocity $\omega_{ref1}$, which is obtained from equation (20). In this regard, when the PLD variation is changed from $f(t)$ to $g(t)$, the change ($\Delta\omega_{2\epsilon}$) of the second roller 102 is represented by the following equation (28):

$$\Delta\omega_{2\epsilon}=(V_0/R_2)[(k_1/R_1)\{g(t)-f(t)\}-(k_2/R_2)\{g(t-\tau)-f(t-\tau)\}] \quad (28).$$

Similarly to equation (27), in equation (28) a variation component of the first roller (i.e., the first term) caused by change of the PLD variation of from $f(t)$ to $g(t)$, and a variation component of the second roller (i.e., the second term) caused by change of the PLD variation of from $f(t)$ to $g(t)$ are superimposed. Therefore, the below-mentioned PLD variation update method can correct the errors caused by deviation of the virtual home position from the real home position as well as the errors caused by the change of the PLD variation of from $f(t)$ to $g(t)$.

By modifying equation 28 using the following equation (29), the below mentioned equation (30) can be obtained.

$$\epsilon(t)=g(t)-f(t) \quad (29), \text{ and}$$

$$\Delta\omega_{2\epsilon}=(V_0k_2/(R_2)^2)[G\epsilon(t)-\epsilon(t-\tau)] \quad (30),$$

wherein G is defined above (i.e., $k_2R_1/k_1R_2$).

The function $\epsilon(t)$ can be determined by performing such a filtering processing as mentioned above in the PLD determination method using the deviation $\Delta\omega_{2\epsilon}$. The thus determined function $\epsilon(t)$ is added to the last PLD variation $f(t)$ to obtain a new PLD variation $f'(t)$. As shown by the following equation (31), the new PLD variation $f'(t)$ is equal to the PLD variation $g(t)$ after change.

$$f'(t)=f(t)+\epsilon(t)=f(t)+g(t)-f(t)=g(t) \quad (31)$$

By performing the belt drive controlling operation using the new PLD variation $f'(t)$ instead of the last PLD variation $f(t)$, a proper belt drive controlling on the basis of the changed PLD variation $g(t)$ can be performed.

In the above-mentioned method, the function $\epsilon(t)$ is obtained using deviation $\Delta\omega_{2\epsilon}$, and the PLD variation $f(t)$ is changed to $g(t)$ to update the PLD variation. However, a method, in which the function $g(t)$ is directly determined to update the PLD variation, can also be used.

Next, the place, at which rotary encoders are set to measure the rotation angular velocities $\omega_1$ and $\omega_2$, will be explained.

In the above-mentioned belt drive controlling methods, the belt moving speed can be controlled if the rotation angular velocities $\omega_1$ and $\omega_2$ of the two rollers 101 and 102 can be determined. The place, at which rotary encoders are set, is preferably selected from the following three places.

In a first example, rotary encoders are set on two driven rollers (such as the rollers 101 and 102) as illustrated in FIG. 15. In a second example, rotary encoders are set on the driving roller 105 and one driven roller. In a third example, rotary encoders are set on the driving roller and the two driven rollers. The second and third examples can include not only a case where a rotary encoder is set on the shaft of the driving roller 105, but also a case where a rotary encoder is set on the shaft of the driving motor 106.

In the first example, a rotary encoder is set on each of the rollers 101 and 102. In this case, feedback controlling is performed to control the rotation angular velocity $\omega_1$ of the first roller 101 at the target $\tau_{ref1}$ determined by the controller 110*a*. Therefore, the PLD variation $f(t)$ can be precisely determined while correcting errors such as transmission errors and errors caused by slipping of the belt on the driving roller 105. For example, while the driving roller 105 is subjected to feedback controlling, the PLD variation $f(t)$ is determined by measuring the rotation angular velocity $\omega_2$ of the second roller 102. By using this method, the PLD variation $f(t)$ can be precisely determined without being influenced by transmission errors and errors caused by slipping of the belt on the driving roller 105.

Figure 16:
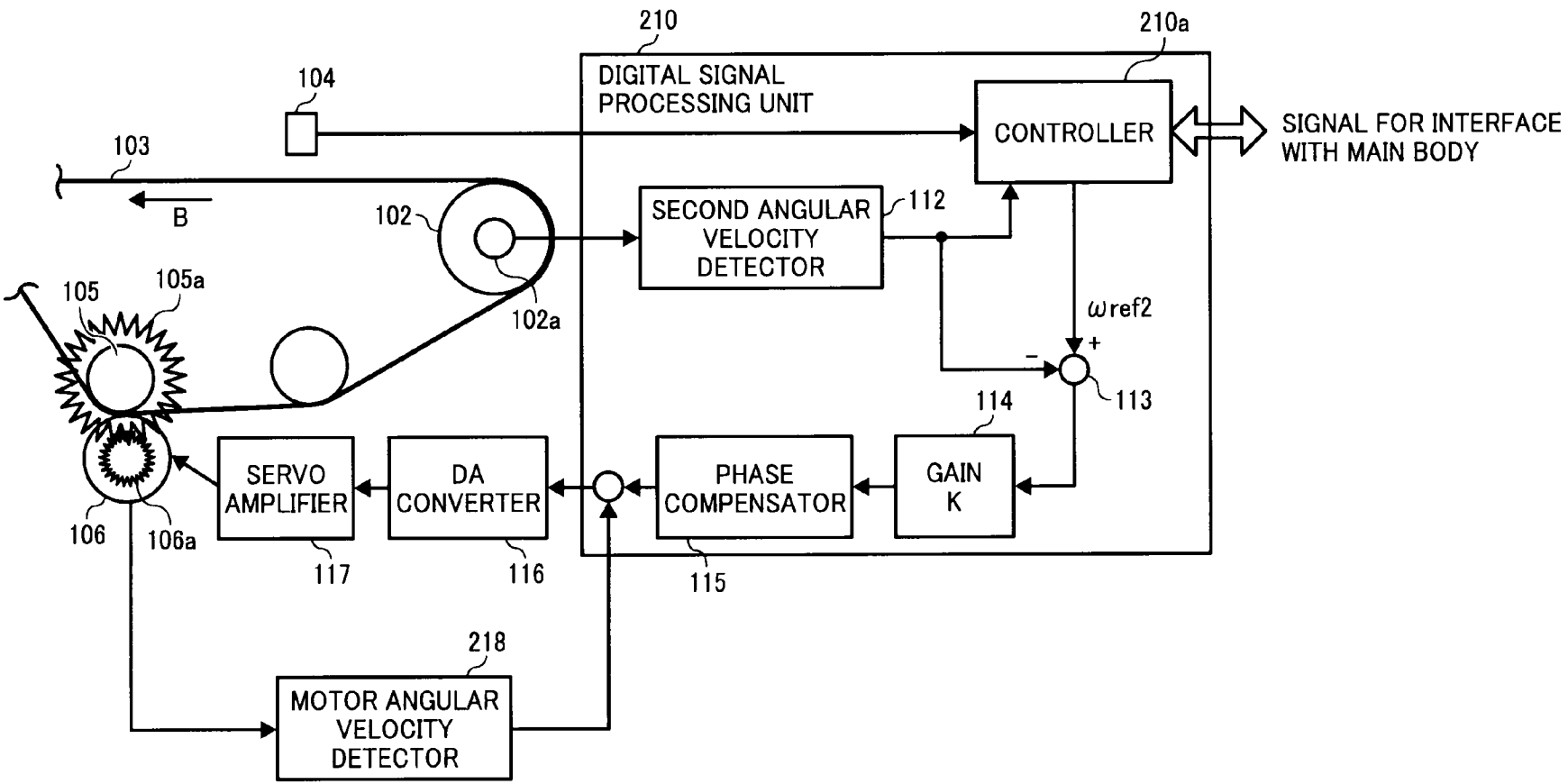
FIG. 16 is a schematic view for explaining a second example of the belt drive controlling operation using a rotary encoder.

FIG. 16 is a schematic view illustrating a belt device for use in the second example mentioned above. In the belt device illustrated in FIG. 16, the motor 106 and the driving roller 105 are connected with the gears 106*a* and 105*a*. The driving motor 106 is a DC servomotor, and an encoder is set on the shaft of the motor or on the shaft of the driving roller 105 to measure the rotation angular velocity thereof, and thereby feedback controlling is performed.

In this device, the DC servomotor can be replaced with s stepping motor, in which the rotation angular velocity thereof depends on the frequency of the input driving pulse. In this case, when feedback is not received from the encoder, controlling can be performed by controlling the frequency of the input driving pulse. Therefore, it is not necessary to provide an encoder on the motor shaft or the driving roller shaft.

In the second example, the rotation angular velocities $\omega_m$ and $\omega_2$ of the driving motor and the driven roller 102 can be measured by the encoders. The rotation angular velocity $\omega_m$ of the shaft of the driving motor has a certain relationship with the rotation angular velocity of the driving roller 105. Therefore, the rotation angular velocity $\omega_m$ of the shaft of the driving motor in the second example corresponds to the rotation angular velocity $\omega_1$ of the first roller 101 in the first case. When a decelerating mechanism is provided on the driving motor, the rotation angular velocity corresponding to the rotation angular velocity $\omega_1$ is determined while considering the deceleration ratio. Thus, in the second example, the PLD variation $f(t)$ can be precisely determined similarly to the first example.

However, in the second example, the rotation angular velocity $\omega_2$ of the second roller 102 measured with the second angular velocity detector 112 includes variations caused by drive transmission errors and slipping of the belt 103 on the driving roller 105. Therefore, it is preferable to decrease such variations when determining the PLD variation $f(t)$. Particularly, it is preferable to roughen the surface of the driving roller 105 so that the friction coefficient of the roller against the belt increases.

The device illustrated in FIG. 16 for use the second example includes the rotary encoder 102*a*, the mark detection sensor 104, the DA converter 116, the servo amplifier 117, and a motor angular velocity detector 218. A digital signal processing unit 210 (serving as a processor) of the device includes a controller 210*a*, the comparator 113, the gain 114 and the phase compensator 115. Since the rotary encoder 101*a* is not provided on the driven roller 101 in this device, the device has a lower cost than the device used for the first example illustrated in FIG. 15.

Figure 17:
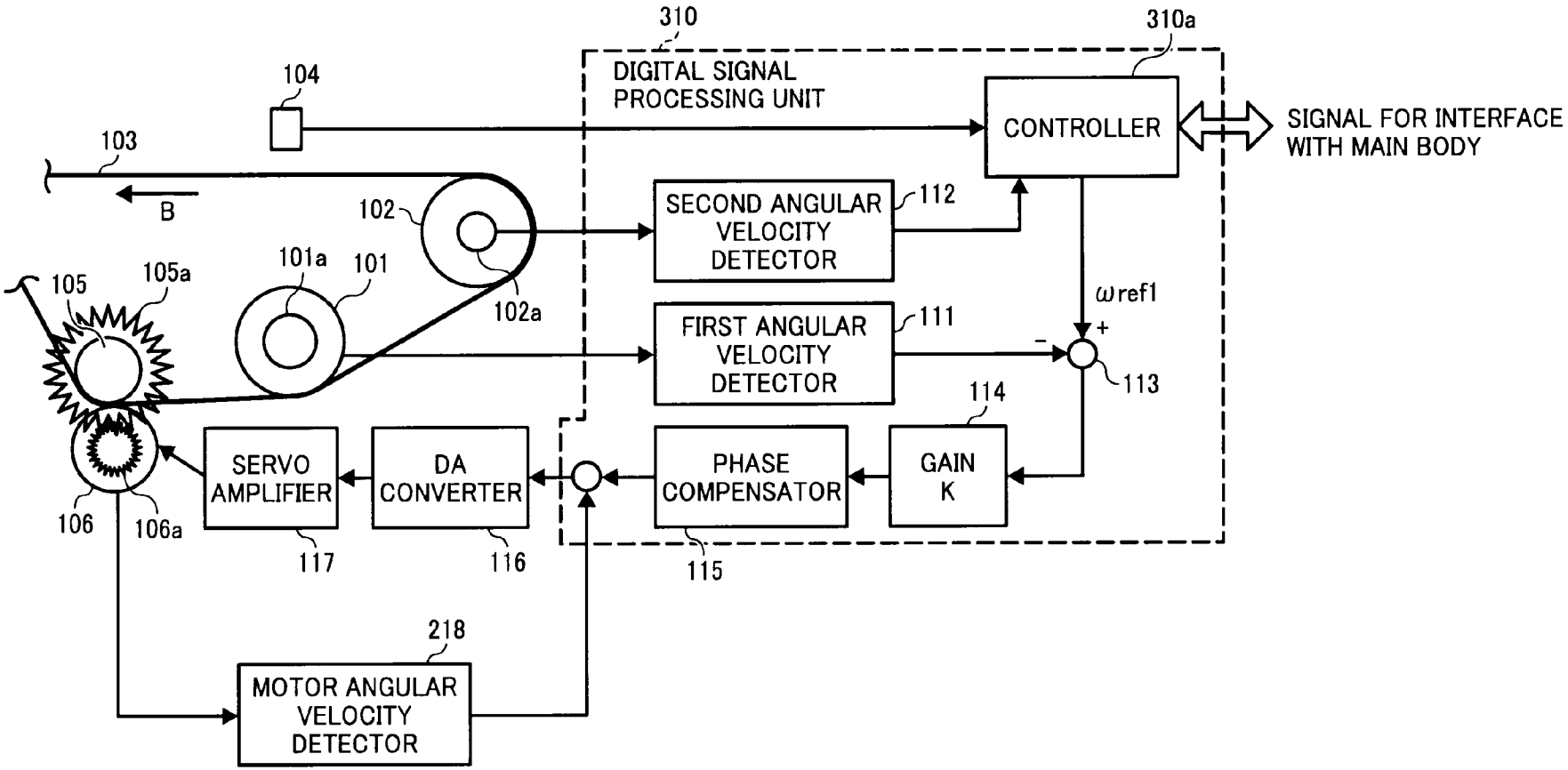
FIG. 17 is a schematic view for explaining yet another example of the belt drive controlling operation using a rotary encoder.

FIG. 17 is a schematic view illustrating a belt device for use in the third example mentioned above. Similarly to the device for use in the second example illustrated in FIG. 16, DC servomotors and stepping motors, which can control rotation angular velocity thereof, can be used as the driving motor 106 of the belt device illustrated in FIG. 17. In addition, similarly to the device for use in the first example illustrated in FIG. 15, the rotary encoders 101*a* and 102*a* are provided on the driven rollers 101 and 102, respectively.

The device illustrated in FIG. 17 further includes the rotary encoder 102*a*, the mark detection sensor 104, the DA converter 116, the servo amplifier 117, and the angular velocity detector 218. In addition, a digital signal processing unit 310 of the device includes a controller 310*a*, the comparator 113, the gain 114 and the phase compensator 115.

Thus, the device illustrated in FIG. 17 can precisely determine the PLD variation similarly to the device for use in the first example illustrated in FIG. 15. In addition, since the device has a minor loop, i.e., a configuration such that information on the rotation angular velocity $\omega_m$ of the shaft of the motor, the device can stably perform belt drive controlling.

In addition, while the shaft of the motor is rotated at a constant speed and thereby the driving roller 105 is also rotated at a constant speed, the average rotation angular velocities of the first and second rollers are determined. Therefore, the ratio between the diameters of the first and second rollers can be precisely determined. Therefore, even when the diameters of the first and second rollers change due to manufacturing errors, changes of environmental conditions, and abrasion after long repeated use, and thereby the roller effective radiuses of the rollers are deviated from the respective real radiuses, the ratio thereof can be corrected.

Figure 18:
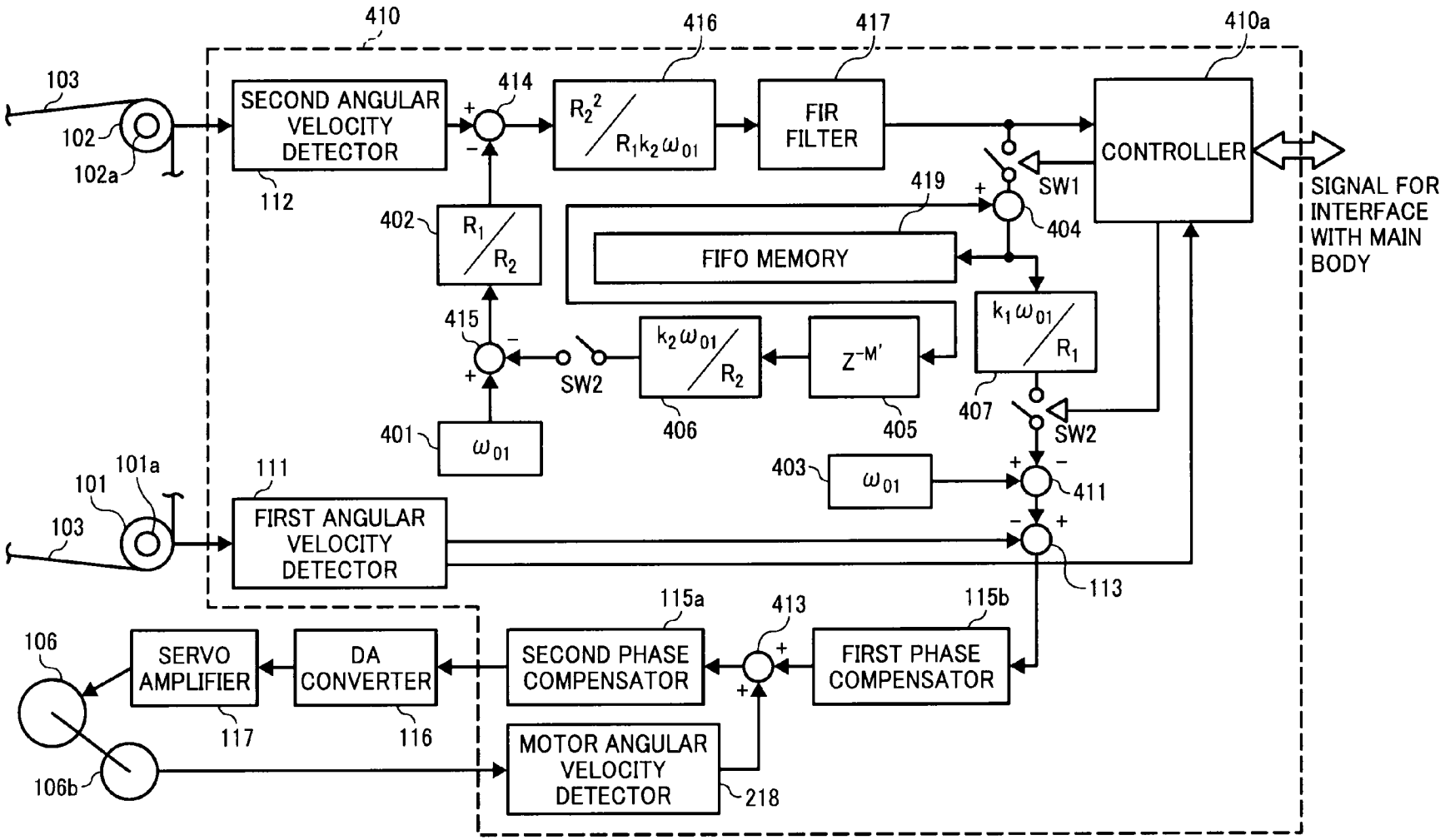
FIG. 18 is a circuit diagram for explaining the first method for renewing the pitch line distance (PLD) variation.

FIG. 18 is a circuit diagram for explaining the first example of updating of the PLD variation $f(t)$. Any one of the PLD determining methods mentioned above can be used for this example.

The device illustrated in FIG. 18 uses the second belt drive controlling method using no home position detection mechanism. In addition, in this device, encoders are set similarly to the third example mentioned above, i.e., an encoder is provided on the shaft of the motor 106 to control driving. As illustrated in FIG. 18, the rotary encoders 102*a* and 102*a* are provided on the driven rollers 101 and 102, respectively. Needless to say, the device can have a configuration such that no encoder is provided on the shaft of the motor.

The first example of updating of the PLD variation will be explained by reference to FIG. 18. A rotary encoder 106*b* illustrated in FIG. 18 and provided on the driving motor 106 is contained in a servomotor used as the driving motor 106.

The device includes a digital signal processing unit 410 surrounded by a dotted line in FIG. 18, which serves as a processor. The digital signal processing unit 410 includes a digital circuit, a DSP, micro CPU, a RAM, a ROM, a FIFO, etc. The hardware configuration is not limited thereto. Some of the control blocks illustrated in FIG. 18 may perform processing by making calculation using a firmware.

This first example includes no home position detection mechanism, and therefore there is a case where the virtual home position deviates from the real home position, resulting in occurrence of phase deviation. In addition, it is possible that the PLD variation of the belt 103 changes depending on changes of environmental conditions and changes of parts after long repeated use. Therefore, it is necessary to update the PLD variation. In this first example, whether to intermittently or continuously update the PLD variation can be determined depending on the load on the processors such as CPUs.

In the intermittent updating method, at first, the variation of the belt moving speed is measured to determine whether the precision of the PLD variation $f(t)$ falls within a predetermined allowable range. If the precision is out of the range, the PLD variation $f(t)$ is updated. Specifically, it is determined whether the absolute value of $\epsilon(t)$ in equation (29), or the average of the absolute value, the square mean thereof or the square root of the square mean falls within a predetermined allowable range. When the value is out of the range, the PLD variation $f(t)$ is updated.

Needless to say, the PLD variation $f(t)$ may be periodically updated depending on the operation time of the copier or the total amount of produced copies. In this regard, when the absolute value of $\epsilon(t)$, or the average of the absolute value, the square mean thereof or the square root of the square mean does not fall within a predetermined allowable range even after updating is performed, the initial data are mistakenly input. Therefore, in such a case, an error report should be output to notify the error.

Specifically, at first a controller 410*a* turns switches SW1 and SW2 off. In addition, the controller compares the reference signal data $\omega_{01}$ ($=V_0/R_1$) of the rotation angular velocity of the first roller 101 with the rotation angular velocity $\omega_1$ of the first roller, and drives the belt 103 so that the first roller rotates at the angular velocity $\omega_{01}$. Two phase compensators 115*a* and 115*b* are provided to stably perform feedback controlling while eliminating the steady-state errors. When the rotation angular velocity $\omega_1$ of the first roller 101 becomes equal to the angular velocity $\omega_{01}$, the rotation angular velocity $\omega_2$ of the second roller 102 is defined by the following equation (32), which is derived from equation (7):

$$\omega_2=(R_1/R_2)\omega_{01}+(k_2R_1/(R_2)^2)\omega_{01}\{f(tn)-G(tn-\tau)\} \quad (32),$$

wherein G is defined above in equation (10).

In this first example of the updating method, a digital processing is performed, and therefore discrete time (tn) is used instead of time (t). Therefore, the PLD variation $f(t)$ is replaced with $f(tn)$.

On the basis of the rotation angular velocity $\omega_2$ of the second roller 102, the PLD variation $f(tn)$ is determined. In addition, the data of the PLD variation per one revolution of the belt 103 are stored in a FIFO memory 419 serving as a variation information storage device. In this processing, at first the switches SW1 and SW2 are turned off, and the fixed data $((R_1/R_2)\omega_{01})$, which are calculated in a block 416, are subtracted therefrom by a subtracter 414.

The data output from the subtracter 414 is multiplied with a fixed data $((R_2)^2/k_2R_1)\omega_{01}$ in the block 416, and the output data are input to a FIR filter in a block 417. Namely, the data output from the block 416 are $\{f(tn)-Gf(tn-\tau)\}$, and the data are input to the FIR filter 417.

The data output from the FIR filter 417 are the n-th time-discretion PLD variation data $fn$ constituting the data row of the PLD variation $f(tn)$. The controller 410*a* controls such that after it is confirmed that the rotation angular velocity $\omega_1$ of the first roller is constant, and precise PLD variation data ƒn are output from the FIR filter 417, the controller turns the switch SW1 on. This is because the FIR filer 417 includes a delay element, and therefore precise PLD variation data ƒn cannot be output in the beginning of the filtering processing. Next, the controller 410*a* counts the number of the pulses output from the encoder for the first roller 101. When the number of the pulses reach predetermined value, i.e., when the controller judges that the belt 103 rotates by one revolution, the controller turns the switch SW1 off.

The PLD variation data ƒn output from the FIR filter 417 are stored in a PLD variation data FIFO memory 419, which has a capacity such that PLD variation data corresponding to one revolution of the belt can be stored. In this first example of the updating method, when the FIFO memory 419 stores no data, the switch SW1 is turned on, and thereby the PLD variation data ƒn can be stored.

Thus, the PLD variation data ƒn are stored in the FIFO memory 419 every rotation of the belt 103. By generating the reference data $\omega_{ref1}$ of the first roller 101, which is determined by the following equation (33) on the basis of the PLD variation data ƒn, drive controlling corresponding to the PLD variation ƒ(tn) can be performed.

$$\omega_{ref1}=\omega_{01}\{1-(k_1/R_1)fn(t)\} \quad (33)$$

The calculation of the term in the parenthesis { } is performed in the block 407. By turning the two switches SW2 (illustrated in FIG. 18) on, the reference data $\omega_{ref1}$ are output from a subtracter 411. In addition, by turning the switches SW2 on, a processing for determining the control error $\omega_{2\epsilon}$ defined in equation (31) is performed. In this processing, at first the rotation angular velocity of the second roller 102 is calculated in blocks 405 and 406 on the basis of the PLD variation data ƒn stored in the FIFO memory 419. After the constant rotation angular velocity $\omega_{01}$ is added thereto in a block 401, followed by calculation in a block 402, the resultant data are subtracted from the rotation angular velocity $\omega_2$, which is detected by the second angular velocity detector 112, in the subtracter 414. In this regard, the time τ' taken for feeding the belt 103 from the first roller 101 to the second roller 102 can be represented by M'×Ts, wherein M' is a natural number.

The output from the subtracter 414 is $\omega_{2\epsilon}$ defined in equation (30), and are stored in the block 416. Thereby, the output from the FIR filter 417 is input to the controller 410*a* as the PLD variation error data ϵn. The controller 410*a* controls such that when the PLD variation error data ϵn is greater than the predetermined value, the controller turns the switch SW1 on for a time, in which the belt can be rotated by one revolution, to determine the new PLD variation data ƒn. The new PLD variation data are stored in the FIFO memory 419, resulting in updating of the PLD variation.

When the last data of the PLD variation ƒn are stored in the FIFO memory 419 and the switches SW1 and SW2 are turned on, the PLD correction represented by equation (32) is performed in an adder 404, and the corrected PLD variation is stored in the FIFO memory 419. When the PLD variation data ƒn are accumulated in the FIFO memory 419, the average of the data per several revolutions of the belt may be stored in the FIFO memory 419. In this case, the FIFO memory 419 serves as a past information storage device. In addition, with respect to the PLD variation error data ϵn, the average thereof per several revolutions of the belt may be stored in the FIFO memory 419 to decrease the errors caused by random variations such as backrush and noises of the gears.

Next, the continuous updating method will be explained. In this method, the PLD variation modification represented by equation (25) is always performed. Namely, in the example illustrated in FIG. 18 both the switches SW1 and SW2 are set to an ON state.

Specifically, when the FIFO memory 419 stores no PLD variation data, the controller 410*a* at first turns the switch SW1 off. Then the reference signal $\omega_{01}$ is compared with the rotation angular velocity $\omega_1$ of the first roller 101 measured with the first rotation angular velocity detector 111, and the belt 103 is driven so that the rotation angular velocity $\omega_1$ becomes the reference angular velocity $\omega_{01}$. When the output from the FIR filter 417 is stabilized, the switch SW1 is turned on, and the PLD variation data ƒn per one revolution of the belt 103 are stored in the FIFO memory 419. Then both the switches are allowed to be in an ON state, the data of the sum of the data en output from the FIR filter 417 and the data output from the FIFO memory 419 are input to the FIFO memory as new PLD variation data ƒn. It can be understood from equations 28 and 30 that the data ϵn are PLD variation error data obtained from the output from the FIR filter 417. Thus, the new PLD variation data ƒn per one revolution of the belt, in which the errors are corrected, are stored in the FIFO memory 419.

By generating the reference signal $\omega_{ref1}$ on the basis of equation (33) using the PLD variation data ƒn, drive controlling according to the PLD variation ƒ(tn) can be performed. In this case, if the controller 410*a* judges that the PLD variation error data ϵn exceed a predetermined value, the controller notifies the main body of the copier of the abnormality.

This first example of the continuous updating method uses the FIFO memory 419 in which the PLD variation data stored therein are shifted according to the clock signal, and the memory function of the block 405, which output data a predetermined time after input of data thereto. However, the method may perform controlling using an address-administration memory function.

Next, the second example of the continuous updating method for updating the PLD variation ƒn will be explained. In this second method, unlike the first example in which the PLD variation data ƒn are corrected, controlling is performed while accumulating the newly determined PLD variation data ƒn in the FIFO memory 419. In addition, in this second method, the newly determined PLD variation data ƒn are accumulated in the FIFO memory 419, and controlling is continuously performed using the PLD variation data ƒn for the last one revolution of the belt 103.

At first, the rotation angular velocity $\omega_2$ of the second roller 102 is measured, and new PLD variation data gn are obtained from the data, which are obtained by deleting the reference data $\omega_{ref1}$ from the PLD variation data ƒn. Namely, while controlling drive of the belt on the basis of the PLD variation data ƒn currently stored in the FIFO memory 419, the rotation angular velocity $(\omega_2)'$ of the second roller is determined on the basis of the virtual home position. Next, the reference data $\omega_{ref1}$ is multiplied with $(R_1/R_2)$, and the product is subtracted from the rotation angular velocity $\omega_2)'$ to obtain $(\omega_2)''$. Further, new reference data are determined using $(\omega_2)''$. Thus, drive controlling is performed using the new reference data. The rotation angular velocity $(\omega_2)'$ of the second roller 102 detected on the basis of the virtual home position is represented by the following equation (34):

$$(\omega_2)'=(R_1\omega_{01}/R_2)[1+(k_1/R_1)\{g(tn)-f(tn)\}-(k_2/R_2)\{g(tn-\tau)\}] \quad (34).$$

In addition, $(\omega_2)''$ is determined by the following equation (35):

$$(\omega_2)''=(\omega_2)'-(R_1/R_2)(\omega_{ref1} \quad (35).$$

Therefore, the following equation (36) can be obtained from equations (34) and (35).

$$(\omega_2)''=(k_1/R_2)\omega_{01}\{g(tn)-Gg(tn-\tau)\} \quad (36)$$

In equation (36), G is defined above in equation 9. Since the diameter of the first roller 101 is almost the same as that of the second roller in this example, G is a number close to 1.

The PLD variation data g(tn) can be obtained from equation (36). Specifically, new data row of the PLD variation data gn can be obtained by the FIR filter 417.

Figure 19:
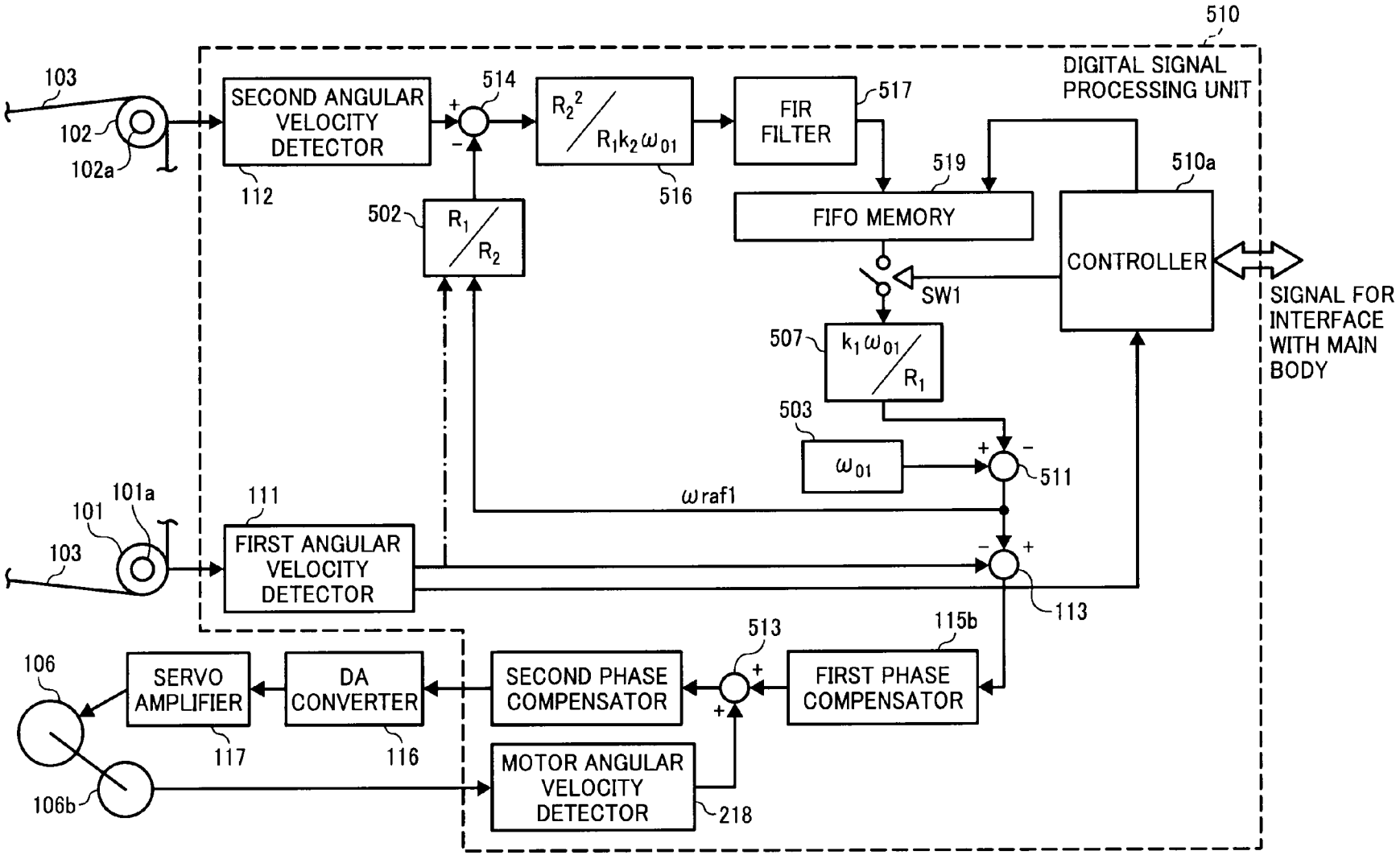
FIG. 19 is a circuit diagram for explaining the second method for renewing the pitch line distance (PLD) variation.

FIG. 19 is a circuit diagram used for explaining the second example of the continuous updating method. In this regard, the rotary encoder 106*b* illustrated in FIG. 19 is included in the DC servo motor used as the driving motor 106 similarly to the rotary encoder 106*a* used for the first example illustrated in FIG. 18. In addition, a digital signal processing unit 510 serving as a processor includes a digital circuit, a DSP, a micro CPU, a RAM, a ROM, a FIFO memory, etc. Needless to say, the configuration of the hardware is not limited thereto. Some of the control blocks in FIG. 19 may perform processing by making calculation using a firmware, if possible.

In this second example, at first, a controller 510*a* of the digital signal processing unit 510 turns the switch SW1 off. Then the reference signal $\omega_{01}$ ($=V_0/R_1$) is compared with the rotation angular velocity $\omega_1$ of the first roller 101 measured with the rotation angular velocity detector 111. In this regard, the belt 103 is driven so that the rotation angular velocity $\omega_1$ becomes the reference angular velocity $\omega_{01}$. When the rotation angular velocity $\omega_1$ becomes the reference angular velocity $\omega_{01}$, the rotation angular velocity $\omega_2$ of the second roller 102 determined by the angular velocity detector 112 is represented by the following equation (37):

$$\omega_2=(R_1\omega_{01}/R_2)[1+(k_1/R_1)\{f(tn)\}-(k_2/R_2)\{f(tn-\tau)\}] \quad (37).$$

The data $\omega_{01}$ output from a subtracter 511 is multiplied with $(R_1/R_2)$ in a block 502, and the fixed data $(R_1\omega_{01}/R_2)$ are input to a subtracter 514. The data output from the subtracter 514 are multiplied with the fixed data $\{(R_2)^2/(R_1k_1\omega_1)\}$ in a block 516. The output data are input to a FIR filter or an IIR filter in a block 517. Namely, the data output from the block 516 is $\{f(tn)-Gf(tn-\tau)\}$, and the data are input to the FIR filter 517. The data output from the FIR filter 517 are PLD variation data $f(n)$ constituting the data row of the PLD variation $f(tn)$.

The controller 510*a* observes the rotation angular velocity $\omega_1$ of the first roller 101. When the rotation angular velocity $\omega_1$ is constant, the switch SW1 is turned on after precise PLD variation data $f(n)$ are output from the FIR filter 517. This is because the FIR filter 517 includes a delay element, and therefore precise PLD variation data $f(n)$ are not output at the beginning of the filter operation.

By calculating the reference data $\omega_{ref1}$ of the first roller 101 according to equation (33) in a block 507 using the PLD variation data $f(n)$, drive controlling on the basis of the PLD variation $f(n)$ can be performed.

In this second example, a FIFO 519 is used when it takes a long time to perform digital signal processing including calculation of the PLD variation data $f(n)$ and the multiplication in the block 507. Namely, the reference signal $\omega_{ref1}$ of the first roller is generated using the PLD variation data corresponding to the last one revolution of the belt.

In addition, since the rotation angular velocity $\omega_1$ of the first roller 101 is controlled on the basis of the reference data $\omega_{ref1}$, the rotation angular velocity $\omega_1$ of the first roller may be directly input to the block 502 as indicated by a chain line in FIG. 19. Further, in this second example, when the above-mentioned signal $(\omega_2)''$ includes errors caused by errors of DC components caused by calculation errors, and variations of the diameters of the rollers 101 and 102 in the manufacturing processes and changes of the diameters caused by temperature changes, errors occur in the subsequent filtering processing in the FIR filter 517. If the errors cause a problem, a high-pass filter is preferably inserted before the FIR filter 517 to remove the DC components of the signal $(\omega_2)''$.

In addition, in the first and second examples, a low-pass filter may be inserted to remove variations such as periodic variations of the first and second rollers, other periodic variations and variations in high frequency ranges. By using such a low-pass filter, correction of variations of the belt moving speed caused by the PLD variation can be stably performed with high precision. The low-pass filter is inserted before the FIR filter 517 or after the angular velocity detector 112.

Further, in the first and second examples, averaging processing may be performed to reduce the random detection errors caused by backrush and noises of the gears. Specifically, the data $f(n)$ stored in a time in which the belt is rotated by N revolutions (N is a natural number) are input to a RAM in a FIFO (First-In-First-Out) manner, and the data in the RAM corresponding to N or less revolutions of the belt are averaged. The average data are used as the PLD variation data. When the PLD variation data are continuously updated, the reference data are generated on the basis of the average of the last N-pieces of PLD variation data. Furthermore, in the first and second examples, the reference rotation angular velocity data $\omega_{ref1}$ may be converted to reference rotation angular displacement data. In this case, controlling is performed by comparing the reference data with the rotation angular displacement data obtained from the data output from the rotary encoder 101*a* set on the first roller 101.

In addition, in the first and second examples, PLL controlling, in which the reference data $\omega_{ref1}$ are converted to a pulse row to control the phases of the pulses continuously output on the basis of the output from the rotary encoder 101*a*, may be performed.

As mentioned above, the examples of the belt drive controlling device have configuration such that the belt 103 is supported by the support rollers 101, 102 and 105 (illustrated in FIGS. 15-17), wherein the roller 105 is the driving roller. In the examples, rotation of the driving roller 105 is controlled to control drive of the belt 103. The belt drive controlling device has a digital signal processing unit, which serves as a controlling device for controlling rotation of the driving roller 105 such that variation of the belt moving speed caused by the PLD variation of the belt in the circumferential direction thereof is controlled so as to be decreased on the basis of the information on the rotation angular displacement or rotation angular velocity of the two rollers 101 and 102 having the same effective radius.

In the belt drive controlling device, the digital signal processing unit determine the PLD variation information $f(t)$ while considering a point on the passage of the belt as a virtual home position, and performing the above-mentioned controlling on the basis of the PLD variation information $f(t)$. The belt drive controlling device performs controlling while considering that the PLD variations determined from the rotation angular velocities $\omega_1$ and $\omega_2$ of the two driven rollers 101 and 102, which change depending on the variables such as roller's effective radius $R_1$ and $R_2$, belt contact angles, materials constituting the belt, and the layer structure of the belt, are the same. Thus, the PLD variation, which influences the relationship between the rotation angular velocities $\omega_1$ and $\omega_2$ of the two driven rollers and the belt moving speed, can be precisely determined on the basis of the rotation angular velocities $\omega_1$ and $\omega_2$ (or rotation angular displacement) even when the PLD variation is complex. In addition, the belt drive controlling device controls drive of the belt 103 such that variation of the belt moving speed V caused by the PLD variation is decreased.

When the belt 103 is a single-layered belt having a uniform composition, drive controlling may be performed using the belt thickness variation instead of the PLD variation, which has a certain relationship with the belt thickness variation. Namely, rotation of the driving roller 105 is controlled on the basis of the rotation angular velocities $\omega_1$ and $\omega_2$ (or rotation angular displacement) such that the variation of the belt moving speed V caused by the belt thickness is decreased.

The belt drive controlling device can have a PLD variation data FIFO memory 419 serving as a variation information storage device, which stores the PLD variation information $f(t)$ in a period corresponding to the time Tb needed for rotating the belt by one revolution. By proving such a storage device, calculation time needed for calculating the corrected PLD variation information $f(t)$ and for other calculation operations can be secured.

In addition, the belt drive controlling device repeatedly obtains the PLD variation information $f(t)$ at predetermined intervals. Therefore, at a time when the PLD variation falls out of a predetermined allowable range due to changes of environmental conditions and deterioration of the belt after long repeated use, the PLD variation information $f(t)$ is determined again, and thereby drive of the belt can be precisely controlled even when the PLD variation of the belt 103 is changed.

In the first example of the belt drive controlling device mentioned above, the PLD variation information is determined at a time when the difference between the real PLD variation data and the PLD variation predicted from the belt position and the PLD variation information $f(t)$ falls out of a predetermined allowable range. Therefore, belt drive controlling can be precisely performed.

In the second example of the belt drive controlling device mentioned above, the above-mentioned drive controlling is performed while obtaining the PLD variation information. In this case, belt drive controlling can be performed more precisely. In addition, it is not necessary for the second example to store the PLD variation information $f(t)$ per one revolution of the belt, and therefore it is not necessary to provide a storage device for storing the information.

The belt drive controlling device can include a PLD variation data FIFO memory 419, which serves as a past information storage device and which stores the past PLD variation information per one or more revolutions. In this case, it is possible that the newly determined PLD variation information and the past PLD variation information are subjected to an averaging processing, and the average value is used for the PLD variation information $f(t)$ to control drive of the belt. In this case, since the past PLD variation information and the newly determined PLD variation information are subjected to an averaging processing, the PLD variation information $f(t)$ can be determined with higher precision. By using this method, the detection errors caused by random variations due to backrush and noises of the gears can be eliminated.

The belt device of the present invention has a belt such as the belt 103 supported by plural rollers including support rollers such as the rollers 101 and 102 and the driving roller 105, a driving motor such as the driving motor 106 for generating driving force therefor, rotary encoders serving as detectors for detecting the rotation angular displacement or rotation angular velocities $\omega_1$ and $\omega_2$ of the support rollers 101 and 102, and angular velocity detectors such as first and second angular velocity detectors 111 and 112. In addition, the belt device has the above-mentioned belt drive controlling device configured to control drive of the belt by controlling rotation of the driving roller 105. Therefore, the belt device can control drive of the belt with high precision.

In the first example of the rotary encoder of the belt device, the rollers 101 and 102 are driven rollers driven by the belt 103 driven by the driving roller 105. In this case, the PLD variation $f(t)$ can be determined with high precision without being influenced by variables such as slipping of the belt on the driving roller.

Particularly, in the third example of the rotary encoder of the belt device, the driving motor has a feedback device, in which the rotation angular displacement or angular velocity $\omega_m$ of the motor is detected, and drive controlling is performed such that the rotation angular displacement or angular velocity $\omega_m$ of the motor becomes the target. In this regard, feedback is performed to a motor driving circuit (i.e., motor drive controller). By using such a device, belt drive controlling can be performed more stably.

In the second example of the rotary encoder of the belt device, the driving roller 105 is used as one of the two rollers, whose rotation angular displacement or angular velocities are used for determining the PLD variation information $f(t)$. In this case, the belt device has a detector configured to detect the rotation angular displacement or angular velocity $\omega_m$ of the driving motor 106, or the target rotation angular displacement or angular velocity input to the driving motor 106. The belt device having such configuration uses only one rotary encoder if a pulse motor is used as the driving motor 106. Therefore, the belt device has low manufacturing costs. Specifically, one of the rotation angular velocities (or displacement) is the rotation angular velocity of the driving roller 105, which is constant. Therefore, the PLD variation information $f(t)$ can be determined from the rotation angular velocity $\omega_2$ (or displacement) of the other roller (such as the roller 102). Thus, the PLD variation determining method can be simplified.

As mentioned above in the first example of the belt drive controlling method, the belt device can include a mark detection sensor such as the mark detection sensor 104 configured to detect a home position mark such as the home position mark 103*a*, which is formed on the belt 103 as the reference point thereof. The relationship between the real position of the belt and the belt position, which corresponds to the determined PLD variation data $f(t)$, is determined on the basis of the time when the home position mark is detected, and then controlling is performed on the basis of the relationship. By using this method, the reference point of the belt can be determined, and the belt drive controlling can be properly performed on the basis of the determined PLD variation data $f(t)$.

In addition, as mentioned above in the second example of the belt drive controlling method, the relationship between the real position of the belt and the belt position, which corresponds to the determined PLD variation data $f(t)$, is determined on the basis of the preliminarily determined average time needed for the belt to rotate by one revolution or the preliminarily determined peripheral length of the belt, and then drive controlling is performed on the basis of the relationship. By using this method, the reference point (i.e., virtual home position) can be determined without forming a home position mark and without providing the mark detection sensor, resulting in reduction of the costs of the belt device.

When the belt is a seam belt, the seam portion tends to have a lager thickness than the other portions, and the properties such as expansion/contraction ratio of the seam portion tend to be different from those of the other portions of the belt. In this case, even when the thickness is the same, the PLD of the seam portion is largely different from that of the other portions.

Even when such a seam belt as having a protruding PLD variation is used, the belt drive controlling device of the present invention can determine the PLD variation with high precision. Therefore, precise drive controlling can be performed without causing a problem in that the belt moving speed is varied when the seam portion is contacted with the support rollers.

When the belt is a multi-layered belt, the PLD varies depending on variation of the layer structure of the belt, resulting in variation of the belt moving speed. Even in such a case, the belt drive controlling device can perform drive controlling with high precision because the device determines the PLD variation and performs drive controlling on the basis of the PLD variation.

In a modified example, which is not illustrated in a figure, a driving pulley or a driven pulley having plural teeth may be provided on the support rollers. When a timing belt having teeth to be contacted with the teeth of the pulley is used, the PLD of the timing belt varies, and thereby the belt moving speed is varied. Namely, the belt moving speed can vary even when the shape or structure of the belt does not vary, if the PLD of such a timing belt is changed. Therefore, not only belts such as the intermediate transfer belt 11 illustrated in FIG. 5, which is driven by the friction between the belt and support rollers, but also toothed belts such as timing belts can cause PLD variation, resulting in variation of the belt moving speed. As mentioned above, the belt drive controlling device of the present invention can be applied to the toothed belts. Namely, the device determines the PLD variation of a toothed belt, and performs belt drive controlling with high precision on the basis of the PLD variation.

Hereinbefore, the explanation is performed by reference to the rotation angular velocity. However, the rotation angular velocity may be replaced with the rotation angular displacement. Specifically, since the rotation angular displacement can be determined by integrating the rotation angular velocity, the relationship between the PLD variation and the rotation angular displacement can also be determined. More specifically, by deleting the average increased displacement (i.e., the slope of the curve of the displacement) from the detected rotation angular displacement to determine the variation of the rotation angular displacement. Then the PLD variation $f(t)$ is determined from the rotation angular displacement variation thus determined similarly to the above-mentioned PLD variation determining methods.

The belt drive controlling device can be applied to any image forming apparatus using an image forming method such as electrophotography, inkjet recording and printing and a belt (such as paper feeding belts, photoreceptor belts, intermediate transfer belts, and fixing belts) as well as the copier illustrated in FIG. 5, i.e., an electrophotographic tandem image forming apparatus using an intermediate transfer medium. By using the belt drive controlling device for such image forming apparatuses, drive of the belt therein can be controlled with high precision.

Needless to say, the belt drive controlling device can also be applied to devices and apparatuses using a belt supported by plural rollers including a driving roller and a driven roller.

This document claims priority and contains subject matter related to Japanese Patent Application No. 2007-102206, filed on Apr. 9, 2007, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A belt drive controlling device for controlling drive of an endless belt supported by plural support rollers including a driving roller configured to drive the endless belt to rotate, and a driven roller rotated by the endless belt, comprising:

a processor configured to perform an arithmetic processing to extract one of two pieces of information on rotation variation, which are included in information on rotation angular displacement or rotation angular velocity of any two of the plural support rollers and which have different phases and a period corresponding to a rotation period of the endless belt, and to control drive of the endless belt on the basis of information obtained from the arithmetic processing, wherein the arithmetic processing is performed by one method selected from the group consisting of a first method including:

1) subjecting information on a difference between the two pieces of information on rotation variation to a delay processing, in which a predetermined time determined on the basis of a distance between the two support rollers in a moving direction of the endless belt is delayed;

2) adding the information on the difference between the two pieces of information on rotation variation to information obtained from the delay processing 1);

3) subjecting information obtained from the addition processing 2) to the delay processing 1);

4) adding the information on the difference between the two pieces of information on rotation variation to information obtained from the delay processing 3);

5) repeatedly performing a combination of the delay processing 3) and the addition processing 4) n-times (n is an integer of not less than 1) on information obtained from the addition processing 4); and 6) dividing a sum of the information on the difference between the two pieces of information on rotation variation and the information obtained from the n-th addition processing with n+1;

a second method including:

the steps of 1) and 2) mentioned above;

3') subjecting information obtained from the delay processing 1) to further delay processing 1);

4') adding the information obtained from the addition processing 2) to information obtained from the delay processing 3');

5') repeatedly performing a combination of the delay processing 3') and the addition processing 4') n-times (n is an integer of not less than 1) on information obtained from the addition processing 4'); and 6') dividing a sum of the information on the rotation variation and information obtained from the n-th addition processing with n+1; and a third method including:

the steps of 1) and 2) mentioned above;

3") subjecting information obtained from the addition processing 2) to the delay processing 1);

4") adding the information before the delay processing 3") to information obtained from the delay processing 3");

5") repeatedly performing the addition processing 4") n-times (n is an integer of not less than 1) on information obtained from the addition processing 4"); and 6") dividing a sum of the information on the rotation variation and information obtained from the n-th addition processing with n+1.

2. The belt drive controlling device according to claim 1, wherein provided that one revolution of the endless belt is $2\pi$ radian, the following relationship is satisfied:

$$\tau'(N_d+1)=2\pi m,$$

wherein $\tau'$ represents difference in phase of the two rollers when the endless belt is moved from one of the two rollers to the other roller, $N_d$ represents a number of the repeated processings, and m is a natural number.

3. The belt drive controlling device according to claim 1, further comprising:

a variation information storage device configured to store information on rotation variation in a time period not shorter than a time needed for the endless belt to rotate by one revolution.

4. The belt drive controlling device according to claim 3, wherein when a difference between the information on rotation variation stored in the variation information storage device and newly determined information on rotation variation exceeds a predetermined range, the processor performs the arithmetic processing again.

5. The belt drive controlling device according to claim 3, wherein the belt drive controlling device performs drive controlling using past information on rotation variation stored in the variation information storage device and newly determined rotation variation information.

6. The belt drive controlling device according to claim 1, wherein the arithmetic processing is repeatedly performed at regular intervals.

7. The belt drive controlling device according to claim 1, wherein the belt drive controlling device performs drive controlling while performing the arithmetic processing.

8. A belt device comprising:

an endless belt;

plural support rollers which support the endless belt and which include:

at least one driving roller configured to drive the endless belt to rotate; and at least one driven roller which is rotated by the endless belt;

a driving source configured to drive the at least one driving roller;

the belt drive controlling device according to claim 1; and a detector configured to detect rotation angular displacement or rotation angular velocity of at least one of any two of the plural support rollers.

9. The belt device according to claim 8, wherein the plural support rollers include at least two driven rollers, and the two support rollers are selected from the at least two driven rollers.

10. The belt device according to claim 8, wherein the driving source includes a feedback device configured to detect rotation angular displacement or rotation angular velocity thereof and to feed back the information on rotation angular displacement or rotation angular velocity thereof.

11. The belt device according to claim 8, wherein the two support rollers include the at least one driving roller.

12. The belt device according to claim 8, further comprising:

a reference mark located on a point of the endless belt; and a mark detection sensor configured to detect the reference mark, wherein the belt drive controlling device starts to obtain the information on rotation variation on the basis of detection of the reference mark, and performs controlling on the basis of the information on rotation variation.

13. The belt device according to claim 8, wherein the belt drive controlling device obtains information on a relationship between pitch line distance variation and position of the endless belt on the basis of preliminarily determined information selected from the group consisting of an average time needed for the belt to rotate by one revolution and a circumferential length of the belt.

14. The belt device according to claim 8, wherein the endless belt has at least one seam.

15. The belt device according to claim 8, wherein the endless belt includes multiple layers in a thickness direction thereof.

16. An image forming apparatus comprising:

an image bearing member configured to bear an electrostatic image thereon;

an image forming unit configured to form and develop the electrostatic image to form a visual image on the image bearing member; and a transfer device configured to transfer the visual image onto a receiving material optionally via an intermediate transfer medium, wherein at least one of the image bearing member and the transfer device includes the belt device according to claim 8.

17. The image forming apparatus according to claim 16, wherein the transfer device includes an intermediate transfer medium, and wherein the intermediate transfer medium includes the belt device.

18. The image forming apparatus according to claim 16, wherein the transfer device includes the belt device, which is configured to feed the receiving material so that the visual image on the image bearing member is directly transferred on the receiving material.

* * * * *